US011060798B2

(12) United States Patent
Machida

(10) Patent No.: US 11,060,798 B2
(45) Date of Patent: Jul. 13, 2021

(54) LOOP HEAT PIPE

(71) Applicant: Shinko Electric Industries Co., LTD., Nagano-Ken (JP)

(72) Inventor: Yoshihiro Machida, Nagano (JP)

(73) Assignee: Shinko Electric Industries Co., LTD., Nagano-ken (JP)

( * ) Notice: Subject to any disclaimer, the term of this patent is extended or adjusted under 35 U.S.C. 154(b) by 190 days.

(21) Appl. No.: 16/263,032

(22) Filed: Jan. 31, 2019

(65) Prior Publication Data

US 2019/0242654 A1 Aug. 8, 2019

(30) Foreign Application Priority Data

Feb. 6, 2018 (JP) ..... JP2018-019487

(51) Int. Cl.
*F28D 15/04* (2006.01)
*F28D 15/02* (2006.01)

(52) U.S. Cl.
CPC ..... *F28D 15/043* (2013.01); *F28D 15/0233* (2013.01); *F28D 15/0266* (2013.01); *F28D 15/046* (2013.01)

(58) Field of Classification Search
CPC .. F28D 15/02; F28D 15/0233; F28D 15/0266; F28D 15/04; F28D 15/043; F28D 15/046; F28F 13/06; F28F 21/089
USPC ..... 165/104.26
See application file for complete search history.

(56) References Cited

U.S. PATENT DOCUMENTS 6,719,040 B2 * 4/2004 Sugito ..... F28D 15/0266 165/104.21
6,863,117 B2 * 3/2005 Valenzuela ..... F28D 15/0233 165/104.21
6,863,119 B2 * 3/2005 Sugito ..... F28D 15/0266 165/104.33
7,051,793 B1 * 5/2006 Schulz-Harder .... F28D 15/0233 165/104.26
8,534,348 B2 * 9/2013 Ohsawa ..... F28D 15/046 165/104.26
8,611,089 B2 * 12/2013 Mizuta ..... H01L 23/427 361/700
10,495,386 B2 * 12/2019 Kiso ..... F28D 15/043
(Continued)

FOREIGN PATENT DOCUMENTS

EP 3 299 758 A1 3/2018
EP 3 460 375 A1 3/2019
(Continued)

OTHER PUBLICATIONS

Extended European Search Report for Application No. EP 19154977.3 dated Jul. 12, 2019.

*Primary Examiner* — Len Tran
*Assistant Examiner* — Gustavo A Hincapie Serna
(74) *Attorney, Agent, or Firm* — Wolf, Greenfield & Sacks, P.C.

(57) ABSTRACT

A loop heat pipe includes an evaporator, a condenser, a liquid pipe, and a vapor pipe. The liquid pipe is formed a metal layer stack of metal layers. The metal layers include a first metal layer through which a first through hole extends in a thickness-wise direction. The liquid pipe includes a flow passage formed by at least the first through hole and having four walls that define the flow passage. The liquid pipe further includes a plurality of porous bodies that form at least two of the four walls of the flow passage.

9 Claims, 16 Drawing Sheets

(56) References Cited

U.S. PATENT DOCUMENTS

| | | | | |
|---|---|---|---|---|
| 2002/0135979 | A1* | 9/2002 | Estes | H01L 23/427 361/688 |
| 2005/0022978 | A1* | 2/2005 | Duval | F28D 15/0233 165/104.26 |
| 2005/0230085 | A1* | 10/2005 | Valenzuela | F28D 15/0233 165/104.26 |
| 2013/0308272 | A1* | 11/2013 | Furuta | F28D 15/04 361/700 |
| 2015/0077929 | A1* | 3/2015 | Honmura | F28D 15/046 361/679.52 |
| 2016/0259383 | A1* | 9/2016 | Shioga | G06F 1/203 |

FOREIGN PATENT DOCUMENTS

| | | | | |
|---|---|---|---|---|
| JP | 2002327993 | A * | 11/2002 | H01L 21/4882 |
| JP | 6146484 | B2 | 6/2017 | |

* cited by examiner

LOOP HEAT PIPE

CROSS-REFERENCE TO RELATED APPLICATIONS

This application is based upon and claims the benefit of priority from prior Japanese Patent Application No. 2018-019487, filed on Feb. 6, 2018, the entire contents of which are incorporated herein by reference.

FIELD

This disclosure relates to a loop heat pipe.

BACKGROUND

A heat pipe is a device that uses phase transition of a working fluid to cool heat-generating components of a semiconductor device (e.g., central processing unit (CPU)) mounted on an electronic device.

Japanese Patent No. 6146484 discloses a loop heat pipe having a loop structure that connects an evaporator, a vapor pipe, a condenser, and a liquid pipe in series and encloses working fluid. The evaporator receives heat from a heat-generating component to change the working fluid from a liquid phase into a gaseous phase. The gaseous working fluid flows through the vapor pipe into the condenser. The condenser removes heat from the gaseous working fluid to condense the working fluid into a liquid phase. The liquid working fluid flows through the liquid pipe into the evaporator.

SUMMARY

In a loop heat pipe, the working fluid may accumulate, for example, in the liquid pipe. For example, in a thermal cycle test that repeats solidification and expansion of working fluid in a loop heat pipe in a short time, an accumulation of the working liquid causes deformation (bulge) of the loop heat pipe. Such a deformed loop heat pipe is a defective. Thus, the accumulation of working fluid needs to be limited.

One embodiment of a loop heat pipe includes an evaporator that vaporizes working fluid, a condenser that liquefies the working fluid vaporized by the evaporator, a liquid pipe that connects the condenser to the evaporator and includes a flow passage that sends the working fluid liquefied by the condenser to the evaporator, and a vapor pipe that connects the evaporator to the condenser to send the working fluid vaporized by the evaporator to the condenser. The liquid pipe is formed by a metal layer stack of a plurality of metal layers. The plurality of metal layers include a first metal layer through which a first through hole extends in a thickness-wise direction. The flow passage of the liquid pipe is formed by at least the first through hole and has four walls that define the flow passage. The liquid pipe further includes a plurality of porous bodies form at least two of the four walls of the flow passage.

Another embodiment of a loop heat pipe includes a metal layer stack of two outermost metal layers and a plurality of intermediate metal layers located between the two outermost metal layers. The metal layer stack includes an evaporator, a vapor pipe, a condenser, and a liquid pipe that are connected to form a loop. The liquid pipe includes one or more flow passages and a plurality of porous bodies. Each flow passage is formed as a single communication hole extending from the condenser to the evaporator along the liquid pipe. Each flow passage extends through at least one of the plurality of intermediate metal layers in a thickness-wise direction and has four walls that define the flow passage. The plurality of porous bodies are formed in at least two of the plurality of intermediate metal layers and arranged to form at least two of the four walls of each flow passage.

Other embodiments and advantages thereof will become apparent from the following description, taken in conjunction with the accompanying drawings, illustrating by way of example the principles of the invention.

It is to be understood that both the foregoing general description and the following detailed description are exemplary and explanatory and are not restrictive of the invention, as claimed.

BRIEF DESCRIPTION OF THE DRAWINGS

The embodiments, together with objects and advantages thereof, may best be understood by reference to the following description of the presently preferred embodiments together with the accompanying drawings in which.

DESCRIPTION OF THE EMBODIMENTS

Various embodiments will be described below. Elements in the accompanying drawings may be enlarged for simplicity and clarity and thus have not necessarily been drawn to scale. To facilitate understanding, hatching lines (shadings) drawn in the plan views may not be illustrated in the cross-sectional views. In this specification, the "plan view"

refers to a cross-sectional view of an object taken in the vertical direction (for example, vertical direction in FIG. 2), and the "planar shape" refers to a shape of an object in the plan view.

Figure 1:
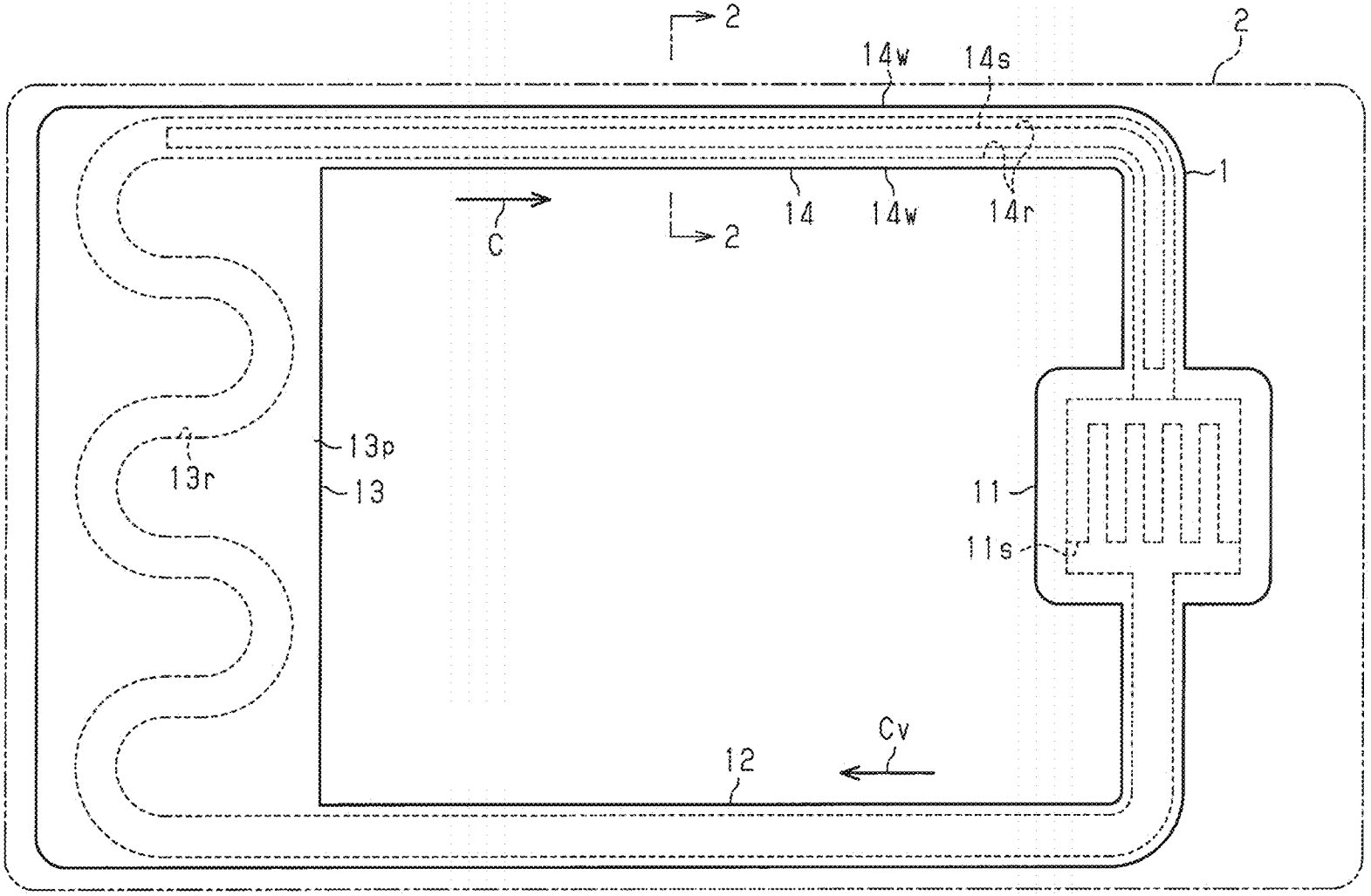
FIG. 1 is a schematic plan view of an example of a loop heat pipe.

As illustrated in FIG. 1, a loop heat pipe 1 is accommodated, for example, in a mobile electronic device 2 such as a smartphone or a tablet terminal.

The loop heat pipe 1 includes an evaporator 11, a vapor pipe 12, a condenser 13, and a liquid pipe 14. The evaporator 11 functions to vaporize a working fluid C and generate a vapor Cv. The condenser 13 functions to liquefy the vapor Cv of the working fluid C. The vapor pipe 12 connects the evaporator 11 to the condenser 13 and sends the working fluid C that is vaporized by the evaporator 11 to the condenser 13. The liquid pipe 14 connects the condenser 13 to the evaporator 11 and sends the working fluid C that is liquefied by the condenser 13 to the evaporator 11. The evaporator 11 and the condenser 13 are connected by the vapor pipe 12 and the liquid pipe 14 to form a loop flow passage through which the working fluid C or the vapor Cv flows. In the present embodiment, the liquid pipe 14 and the vapor pipe 12 have, for example, the same length. However, the liquid pipe 14 and the vapor pipe 12 may have different lengths. For example, the vapor pipe 12 may be shorter than the liquid pipe 14.

The evaporator 11 is configured to be in tight contact with and fixed to a heat-generating component (not illustrated) mounted on the electronic device 2. The evaporator 11 uses heat generated by the heat-generating component to vaporize the working fluid C and generate the vapor Cv. Although not illustrated in the drawings, a thermal interface material (TIM) may be arranged between the evaporator 11 and the heat-generating component. The thermal interface material reduces thermal contact resistance between the heat-generating component and the evaporator 11 and smoothly transfers heat from the heat-generating component to the evaporator 11. The vapor Cv generated by the evaporator 11 is guided through the vapor pipe 12 to the condenser 13.

The condenser 13 includes a heat dissipation plate 13*p* having a large area for heat dissipation and a flow passage 13*r* meandering in the heat dissipation plate 13*p*. The flow passage 13*r* serves as part of the loop flow passage described above. The condenser 13 liquefies the vapor Cv that is drawn through the vapor pipe 12. The working fluid C liquefied by the condenser 13 is guided through the liquid pipe 14 to the evaporator 11.

The liquid pipe 14 includes two walls 14*w* located at opposite sides in the width-wise direction (vertical direction in FIG. 1), a porous body 14*s*, and two flow passages 14*r* extending between the porous body 14*s* and each of the walls 14*w*. The porous body 14*s* extends from the condenser 13 to the evaporator 11 along the liquid pipe 14. The porous body 14*s* produces capillary force and guides the working fluid C liquefied by the condenser 13 to the evaporator 11 with the capillary force. The flow passages 14*r* serve as part of the loop flow passage described above. The flow passages 14*r* enhance smooth flow of the working fluid C through the liquid pipe 14 to the evaporator 11. The evaporator 11 also includes a porous body 11*s*.

The loop heat pipe 1 transfers heat generated by the heat-generating component from the evaporator 11 to the condenser 13 and dissipates the heat in the condenser 13. The loop heat pipe 1 cools the heat-generating component through the circulation of the working fluid C.

Preferably, a fluid having a high vapor pressure and a large latent heat of evaporation is used as the working fluid C. The use of such a working fluid C efficiently cools the heat-generating component with the latent heat of vaporization. Examples of the working fluid C include ammonia, water, chlorofluorocarbon, alcohol, and acetone.

Figure 2:
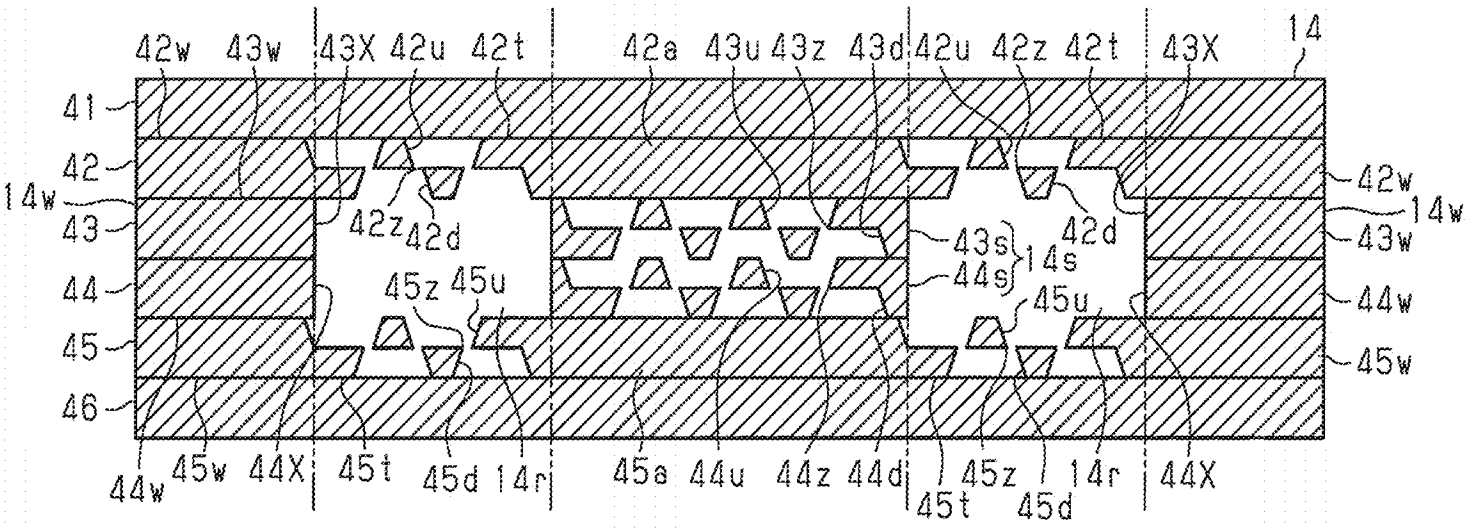
FIG. 2 is a schematic cross-sectional view of a liquid pipe taken along line 2-2 in FIG. 1.

FIG. 2 is a schematic cross-sectional view of the liquid pipe 14 taken along line 2-2 in FIG. 1. The liquid pipe 14 includes a metal layer stack of a plurality of (six, in the present example) metal layers 41 to 46. In the description hereafter, the metal layer 41 may be referred to as the outermost metal layer 41 (or uppermost metal layer 41). The metal layer 46 may be referred to as the outermost metal layer 46 (or lowermost metal layer 46). The metal layers 42 to 45 may be referred to as the intermediate metal layers 42 to 45. When there is no need to distinguish the outermost metal layer from the intermediate metal layers, these metal layers may simply be referred to as the metal layers 41 to 46. The metal layers 41 to 46 are each, for example, a copper layer having a superior thermal conductivity and are directly connected to each other through solid-phase bonding or the like. To facilitate understanding, the metal layers 41 to 46 are separated by the solid lines in FIG. 2. However, for example, when the metal layers 41 to 46 are unified through diffusion bonding, the interfaces of the metal layers 41 to 46 may have been eliminated, and the boundaries of the metal layers 41 to 46 may not be clear.

The metal layers 41 to 46 are not limited to copper layers and may be, for example, stainless steel layers, aluminum layers, or magnesium alloy layers. One or more of the metal layers 41 to 46 may be formed from a material different from that of the remaining metal layers. The thickness of each of the metal layers 41 to 46 may be, for example, approximately 50 μm to 200 μm. One or more of the metal layers 41 to 46 may differ in thickness from the remaining metal layers. Further, all of the metal layers may differ in thickness from each other.

As illustrated in FIG. 1, the evaporator 11, the vapor pipe 12, and the condenser 13 include a metal layer stack of the metal layers 41 to 46 in the same manner as the liquid pipe 14 illustrated in FIG. 2. That is, the loop heat pipe 1 illustrated in FIG. 1 includes the metal layer stack of the metal layers 41 to 46. The number of stacked metal layers is not limited to six and may be five or less or seven or more.

As illustrated in FIGS. 1 and 2, the liquid pipe 14 is formed by the metal layer stack of the metal layers 41 to 46 and includes the two walls 14*w*, the porous bodies 14*s*, 42*t*, and 45*t*, and the two flow passages 14*r*.

As illustrated in FIG. 2, the porous body 14*s* includes porous bodies 43*s* and 44*s* formed in the intermediate metal layers 43 and 44 of the metal layer stack of the metal layers 41 to 46. Each of the flow passages 14*r* includes through holes 43X and 44X respectively extending through the intermediate metal layers 43 and 44 in the thickness-wise direction. In the present embodiment, the outermost metal layers 41 and 46 are free from holes and grooves.

The intermediate metal layer 43 includes two through holes 43X extending through in the thickness-wise direction, two walls 43*w* located at an outer side of the through holes 43X, and a porous body 43*s* located between the two through holes 43X. In the same manner, the intermediate metal layer 44 includes two through holes 44X extending through in the thickness-wise direction, two walls 44*w* located at an outer side of the through holes 44X, and a porous body 44*s* located between the two through holes 44X.

The intermediate metal layers 43 and 44 are stacked so that the through holes 43X and 44X overlap with each other in a plan view.

The intermediate metal layer 42 is stacked on the upper surface of the intermediate metal layer 43, and the intermediate metal layer 45 is stacked on the lower surface of the intermediate metal layer 44. The intermediate metal layers 43 and 44, which include the through holes 43X and 44X, and the intermediate metal layers 42 and 45, which are stacked on the intermediate metal layers 43 and 44, define the two flow passages 14*r*. Each flow passage 14*r* is surrounded by the walls 43*w* and 44*w*, the porous bodies 43*s* and 44*s*, and the intermediate metal layers 42 and 45. The walls 43*w* and 44*w* define one of the two side walls of each flow passage 14*r*, and the porous bodies 43*s* and 44*s* define the other side wall of the flow passage 14*r*. The intermediate metal layer 42 defines the upper wall (ceiling) of the flow passage 14*r*, and the intermediate metal layer 45 defines the lower wall (bottom) of the flow passage 14*r*.

Figure 3:
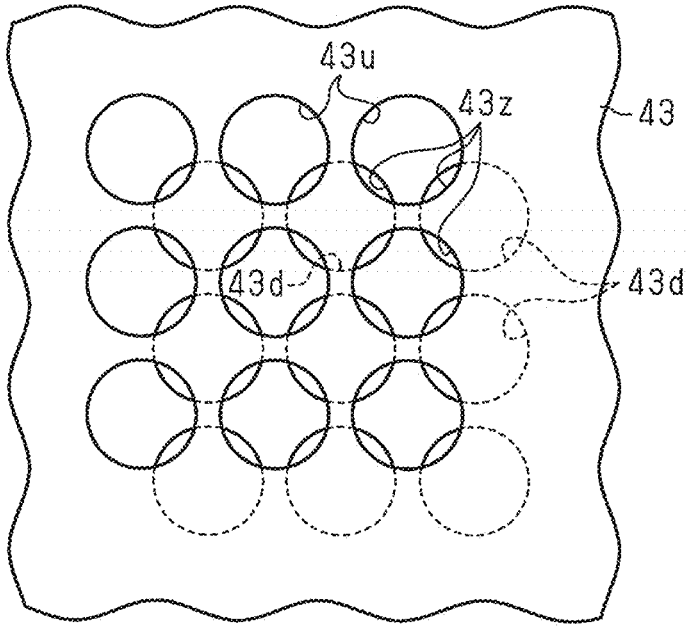
FIG. 3 is a partially schematic plan view of the liquid pipe of FIG. 2 illustrating a metal layer including a porous body.

As illustrated in FIG. 2, the porous body 43*s* includes bottomed holes 43*u* recessed from the upper surface of the intermediate metal layer 43 to a central portion of the metal layer 43 in the thickness-wise direction and bottomed holes 43*d* recessed from the lower surface of the intermediate metal layer 43 to a central portion of the metal layer 43 in the thickness-wise direction. As illustrated in FIG. 3, the bottomed holes 43*u* and 43*d* are circular in a plan view and may have a diameter of 100 μm to 400 μm. However, the bottomed holes 43*u* and 43*d* may have any planar shape and may be, for example, elliptical or polygonal. Each bottomed hole 43*u* may be defined by a tapered side wall that reduces in size from the upper surface toward the central portion of the intermediate metal layer 43. Also, each bottomed hole 43*d* may be defined by a tapered side wall that reduces in size from the lower surface to the central portion of the intermediate metal layer 43.

As illustrated in FIGS. 2 and 3, the bottomed holes 43*u* and 43*d* partially overlap with each other in a plan view. The overlapped portions form fine pores 43*z* connecting the bottomed holes 43*u* and 43*d* to each other. FIG. 3 illustrates one example of arrangement of the bottomed holes 43*u* and 43*d*. The bottomed holes 43*u* and 43*d* may be arranged in any manner to form partially overlapped portions (fine pores 43*z*). The porous body 43*s* including the bottomed holes 43*u* and 43*d* and the fine pores 43*z* is configured to be part of the porous body 14*s*. Although not illustrated in FIG. 2, each of the through holes 43X is in communication with at least one of the bottomed holes 43*u* and 43*d*. For example, each of the through holes 43X is in communication with at least one of the bottomed holes 43*u* and 43*d* via a portion of the side surface of the porous body 43*s* adjacent to the through hole 43X. The walls 43*w* of the intermediate metal layer 43 are free from holes and grooves.

In the same manner as the porous body 43*s*, the porous body 44*s* includes bottomed holes 44*u* recessed from the upper surface of the intermediate metal layer 44 to a central portion of the metal layer 44 in the thickness-wise direction and bottomed holes 44*d* recessed from the lower surface of the intermediate metal layer 44 to a central portion of the metal layer 44 in the thickness-wise direction. The bottomed holes 44*u* and 44*d* may have the same shape as the bottomed holes 43*u* and 43*d* of the porous body 43*s* and may be, for example, circular in a plan view. The bottomed holes 44*u* and 44*d* partially overlap with each other in a plan view. The overlapped portions form fine pores 44*z* connecting the bottomed holes 44*u* and 44*d* to each other. The porous body 44*s* including the bottomed holes 44*u* and 44*d* and the fine pores 44*z* is configured to be part of the porous body 14*s*. Although not illustrated in FIG. 2, each of the through holes 44X is in communication with at least one of the bottomed holes 44*u* and 44*d*. For example, each of the through holes 44X is in communication with at least one of the bottomed holes 44*u* and 44*d* via a portion of the side surface of the porous body 44*s* adjacent to the through hole 44X. The walls 44*w* of the intermediate metal layer 44 are free from holes and grooves.

The intermediate metal layer 42 includes porous bodies 42*t* immediately above the flow passages 14*r*. The porous bodies 42*t* extend along the respective flow passages 14*r*. Each porous body 42*t* defines the upper wall (ceiling) of the corresponding one of the flow passages 14*r*. The porous body 42*t* includes bottomed holes 42*u* recessed from the upper surface of the intermediate metal layer 42 to a central portion of the metal layer 42 in the thickness-wise direction and bottomed holes 42*d* recessed from the lower surface of the intermediate metal layer 42 to a central portion of the metal layer 42 in the thickness-wise direction. The bottomed holes 42*u* and 42*d* may have the same shape as the bottomed holes 43*u* and 43*d* of the porous body 43*s* and may be, for example, circular in a plan view. The bottomed holes 42*u* and 42*d* partially overlap with each other in a plan view. The overlapped portions form fine pores 42*z* connecting the bottomed holes 42*u* and 42*d* to each other. The fine pores 42*z* may have the same shape as the fine pores 43*z* of the porous body 43*s*. The intermediate metal layer 42 includes walls 42*w* located at an outer side of the porous bodies 42*t*. The walls 42*w* are free from holes and grooves. The intermediate metal layer 42 further includes an intermediate portion 42*a* located between the two porous bodies 42*t*. The intermediate portion 42*a* is also free from holes and grooves.

The intermediate metal layer 45 includes porous bodies 45*t* immediately below the flow passages 14*r*. The porous bodies 45*t* extend along the respective flow passages 14*r*. Each porous body 45*t* defines the lower wall (bottom) of the corresponding one of the flow passages 14*r*. The porous body 45*t* includes bottomed holes 45*u* recessed from the upper surface of the intermediate metal layer 45 to a central portion of the metal layer 45 in the thickness-wise direction and bottomed holes 45*d* recessed from the lower surface of the intermediate metal layer 45 to a central portion of the metal layer 45 in the thickness-wise direction. The bottomed holes 45*u* and 45*d* may have the same shape as the bottomed holes 43*u* and 43*d* of the porous body 43*s* and may be, for example, circular in a plan view. The bottomed holes 45*u* and 45*d* partially overlap with each other. The overlapped portions form fine pores 45*z* connecting the bottomed holes 45*u* and 45*d* to each other. The fine pores 45*z* may have the same shape as the fine pores 43*z* of the porous body 43*s*. The intermediate metal layer 45 includes walls 45*w* located at an outer side of the porous bodies 45*t*. The walls 45*w* are free from holes and grooves. The intermediate metal layer 45 further includes an intermediate portion 45*a* located between the two porous bodies 45*t*. The intermediate portion 45*a* is also free from holes and grooves.

As described above, each of the flow passages 14*r* in the liquid pipe 14 is surrounded by the porous bodies 14*s* (43*s*, 44*s*), 42*t*, and 45*t* and the walls 14*w* (43*w*, 44*w*). In other words, the upper wall, the lower wall, and one of the side walls of each flow passage 14*r* are respectively defined by the porous bodies 42*t*, 45*t*, and 14*s* (43*s*, 44*s*), and the other side wall of the flow passage 14*r* is defined by the wall 14*w*.

The porous bodies 42*t* of the intermediate metal layer 42 are in contact with the flow passages 14*r*, and the bottomed holes 42*d* of the intermediate metal layer 42 are in communication with the through holes 43X of the intermediate metal layer 43. The porous bodies 45*t* of the intermediate metal layer 45 are in contact with the flow passages 14*r*, and the bottomed holes 45*u* of the intermediate metal layer 45 are in communication with the through holes 44X of the intermediate metal layer 44. The porous body 43*s* of the intermediate metal layer 43 is in contact with the flow passages 14*r*, and each of the through holes 43X is in communication with at least one of the bottomed holes 43*u* and 43*d* of the intermediate metal layer 43. The porous body 44*s* of the intermediate metal layer 44 is in contact with the flow passages 14*r*, and each of the through holes 44X is in communication with at least one of the bottomed holes 44*u* and 44*d* of the intermediate metal layer 44.

In the structure of the liquid pipe 14 illustrated in FIG. 2, the porous bodies 14*s*, 42*t*, and 45*t* extend from the condenser 13 to the evaporator 11 along the liquid pipe 14. The porous bodies 14*s*, 42*t*, and 45*t* produce capillary force and guide the working fluid C liquefied by the condenser 13 to the evaporator 11 with the capillary force. The flow passages 14*r* enhance smooth flow of the working fluid C in the liquid pipe 14 to the evaporator 11 through the liquid pipe 14.

As illustrated in FIG. 2, the flow passages 14*r* are surrounded by the porous bodies 14*s*, 42*t*, and 45*t* and the walls 14*w*. The capillary force of the porous bodies 14*s*, 42*t*, and 45*t* surrounding each flow passage 14*r* causes the working fluid C flowing in the flow passage 14*r* to readily disperse to the porous bodies 14*s*, 42*t*, and 45*t*. This limits accumulation of the working fluid C in the flow passages 14*r*. Thus, when a thermal cycle test is performed on the loop heat pipe 1, increase in the volume of the working fluid C, which results from the freezing of the accumulated working fluid C at a low temperature, and increase in the volume of the vapor Cv, which occurs at a high temperature, are limited. As a result, deformation and breakage of the liquid pipe 14 are limited.

The method for manufacturing the loop heat pipe 1 will now be described.

Figure 4:
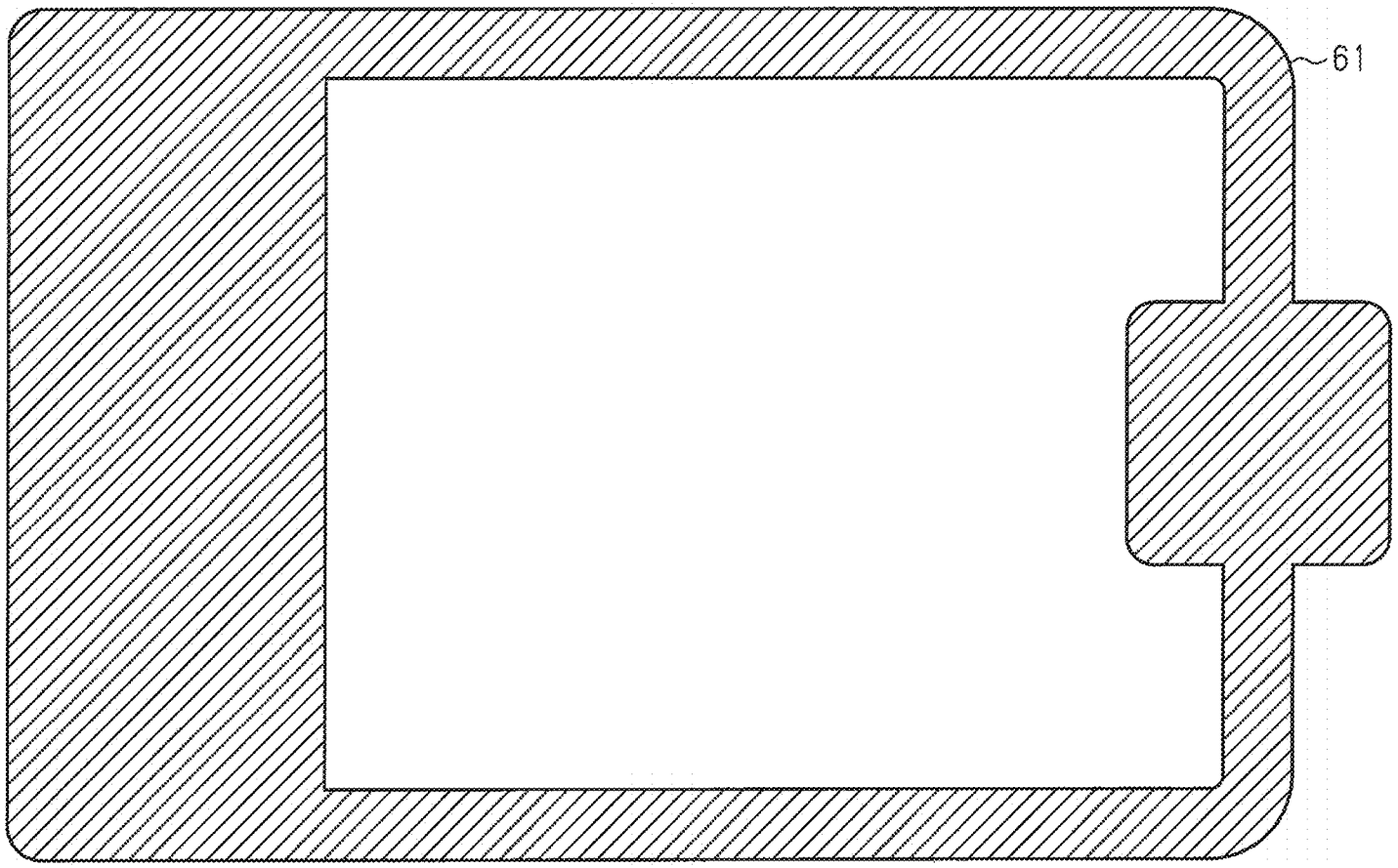
FIG. 4 is a schematic plan view of an uppermost metal layer of the loop heat pipe illustrated in FIG. 1.
Figure 5:
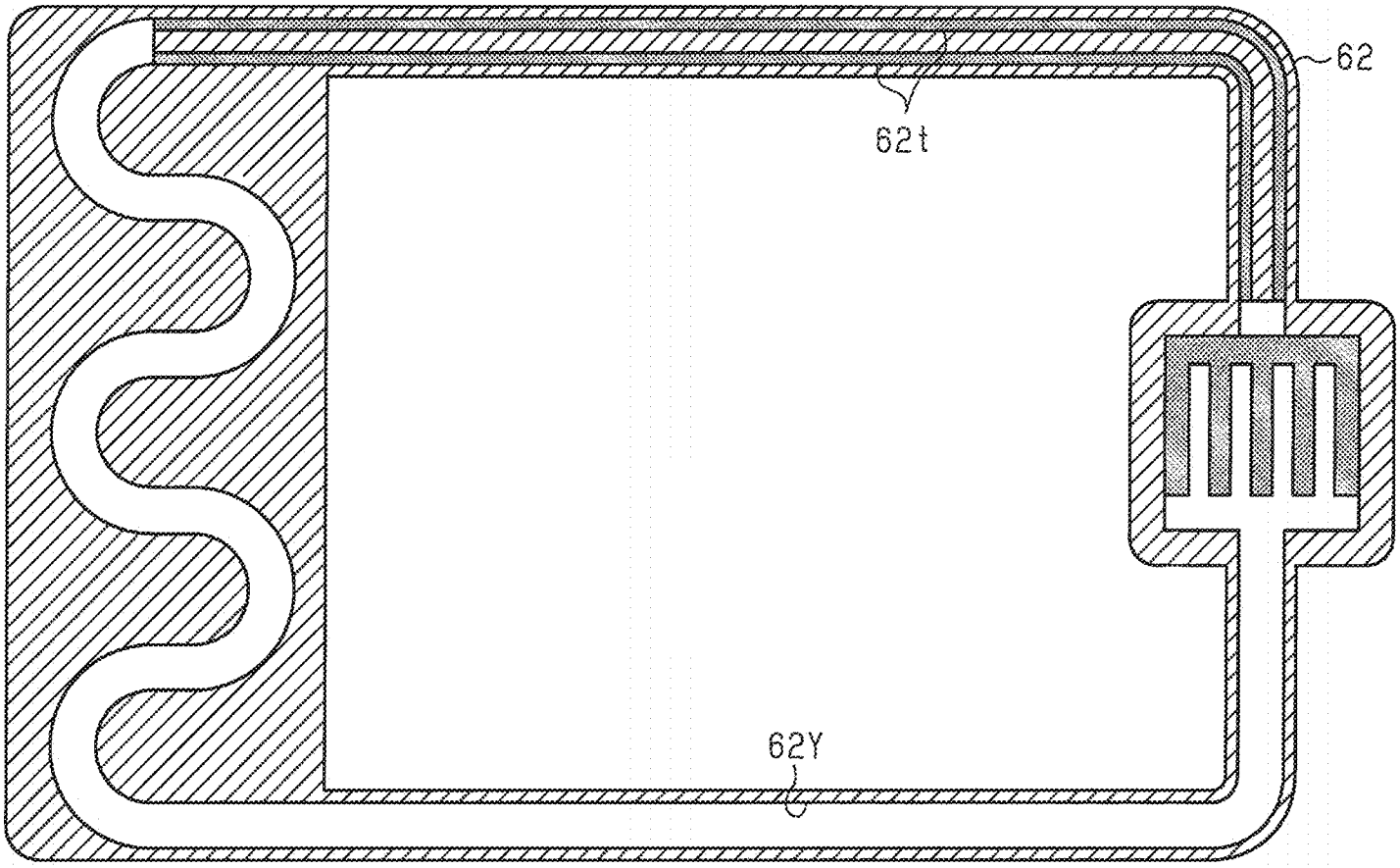
FIG. 5 is a schematic plan view of an intermediate metal layer of the loop heat pipe illustrated in FIG. 1.
Figure 6:
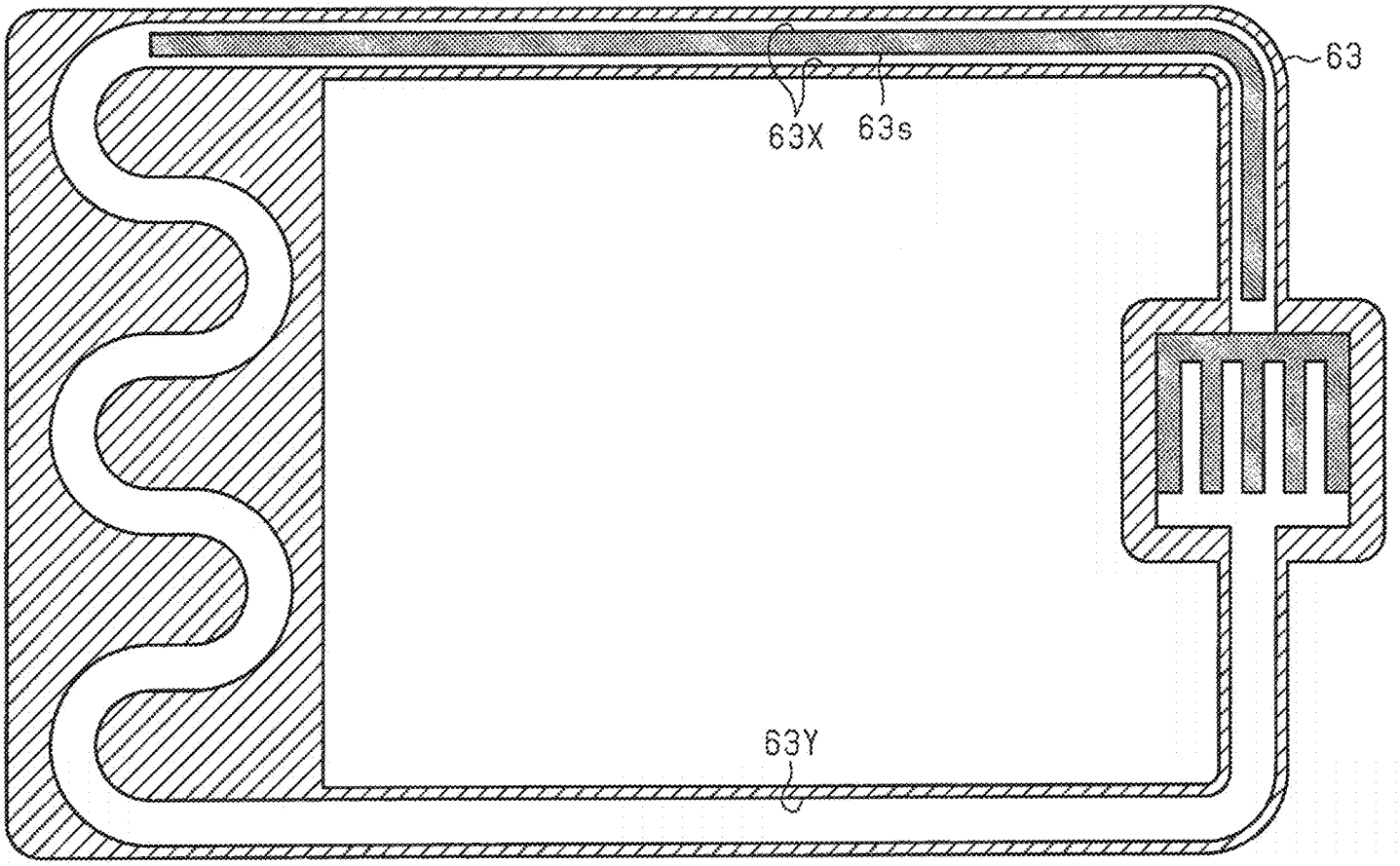
FIG. 6 is a schematic plan view of a lowermost metal layer of the loop heat pipe illustrated in FIG. 1.

FIGS. 4 to 6 are plan views of metal layers used to manufacture the loop heat pipe 1. FIG. 4 is a plan view of a metal layer 61 used as the outermost metal layers 41 and 46 (uppermost metal layer and lowermost metal layer) of the loop heat pipe 1 (refer to FIG. 2).

FIG. 5 is a plan view of a metal layer 62 used as the intermediate metal layers 42 and 45 including the porous bodies 42*t* and 45*t* (refer to FIG. 2). FIG. 6 is a plan view of a metal layer 63 used as the intermediate metal layers 43 and 44 including the porous body 14*s* (43*s*, 44*s*) and the flow passages 14*r* (refer to FIG. 2).

The metal layers 61 to 63 illustrated in FIGS. 4 to 6 are formed, for example, patterning a copper layer having a thickness of 100 μm in a given shape through wet etching. As illustrated in FIG. 4, the metal layer 61 is a solid metal layer that is free from holes and grooves.

As illustrated in FIG. 5, the metal layer 62 includes an opening 62Y corresponding to the shape of the loop flow passage (refer to FIG. 1) formed by the evaporator 11, the vapor pipe 12, the condenser 13, and the liquid pipe 14. The metal layer 62 includes porous portions 62*t* corresponding to the porous bodies 42*t* and 45*t* (refer to FIG. 2). Although not illustrated in FIG. 5 in detail, the porous portions 62*t* include the bottomed holes 42*u*, 42*d*, 45*u*, and 45*d* of the porous bodies 42*t* and 45*t* (refer to FIG. 2).

As illustrated in FIG. 6, the metal layer 63 includes an opening 63Y corresponding to the shape of the loop flow passage (refer to FIG. 1) formed by the evaporator 11, the vapor pipe 12, the condenser 13, and the liquid pipe 14. The metal layer 63 further includes through holes 63X at positions corresponding to the through holes 43X and 44X of the liquid pipe 14 (refer to FIG. 2). The metal layer 63 further includes a porous portion 63*s* corresponding to the porous bodies 43*s* and 44*s* (refer to FIG. 2). Although not illustrated in FIG. 6 in detail, the porous portion 63*s* includes the bottomed holes 43*u*, 43*d*, 44*u*, and 44*d* of the porous bodies 43*s* and 44*s* (refer to FIG. 2).

The method for forming the bottomed holes 42*u*, 42*d*, 45*u*, and 45*d* of the porous bodies 42*t* and 45*t* will now be described.

FIGS. 7A to 7E are cross-sectional views illustrating the steps of forming a portion of the metal layer 62 (here, intermediate metal layer 42) illustrated in FIG. 5 corresponding to the liquid pipe 14.

Figures 7A, 7B, 7C, 7D, 7E:
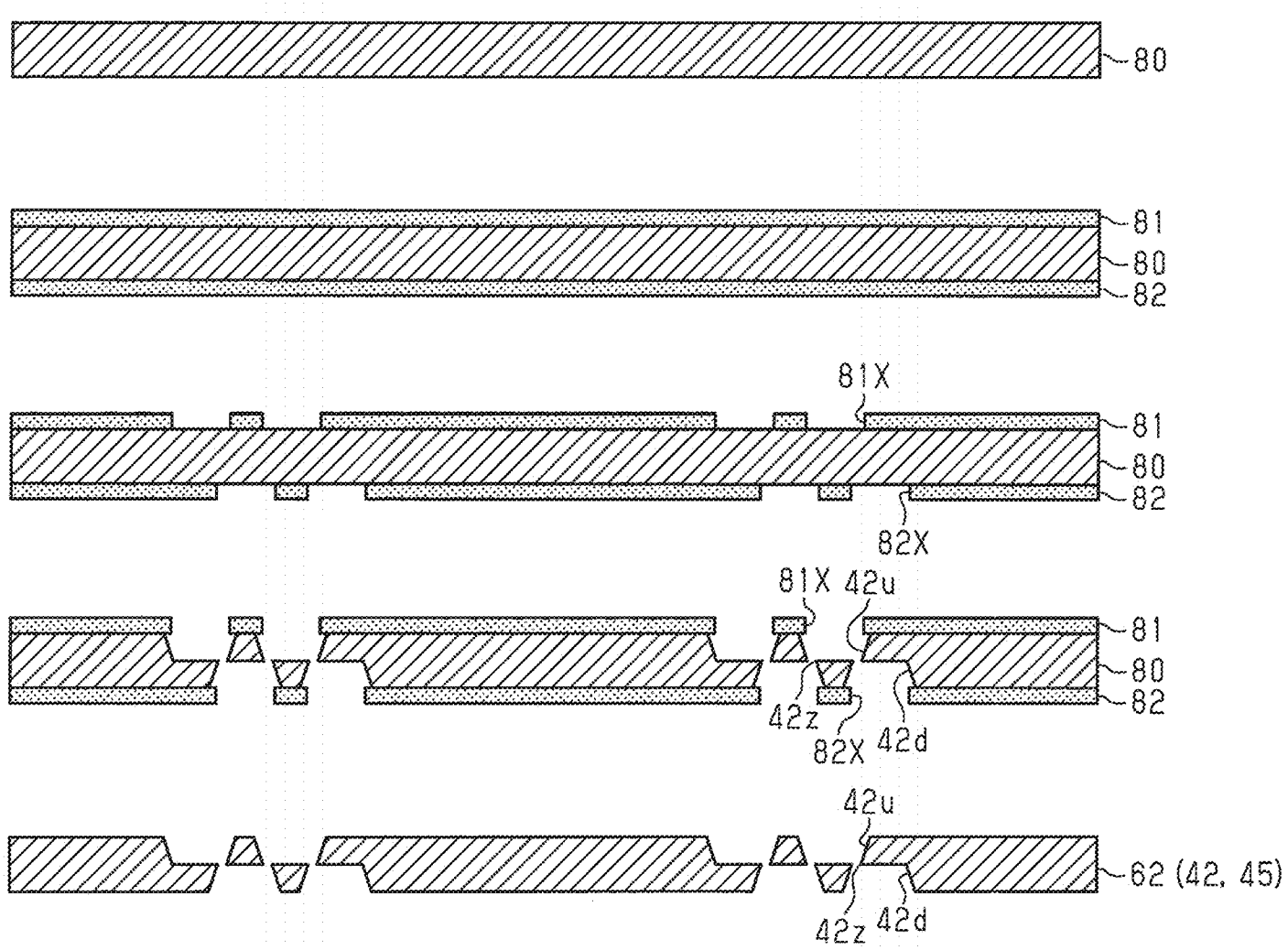
FIGS. 7A to 7E are schematic cross-sectional views illustrating the steps of manufacturing an intermediate metal layer.

In the step illustrated in FIG. 7A, a flat metal sheet 80 is prepared. The metal sheet 80 is a member that is ultimately used as the intermediate metal layer 42 and may be formed from, for example, copper, stainless steel, aluminum, or a magnesium alloy. The thickness of the metal sheet 80 may be, for example, approximately 50 μm to 200 μm.

In the step illustrated in FIG. 7B, a resist layer 81 is formed on the upper surface of the metal sheet 80, and a resist layer 82 is formed on the lower surface of the metal sheet 80. The resist layers 81 and 82 may be, for example, a photosensitive dry film resist.

In the step illustrated in FIG. 7C, the resist layer 81 is exposed and developed to form openings 81X selectively exposing the upper surface of the metal sheet 80. The openings 81X are formed in conformance with the shapes and positions of the bottomed holes 42*u* illustrated in FIG. 2. In the same manner, the resist layer 82 is exposed and developed to form openings 82X selectively exposing the lower surface of the metal sheet 80. The openings 82X are formed in conformance with the shapes and positions of the bottomed holes 42*d* illustrated in FIG. 2.

In the step illustrated in FIG. 7D, the metal sheet 80 exposed in the openings 81X is etched from the upper surface side, and the metal sheet 80 exposed in the openings 82X is etched from the lower surface side. As a result, the bottomed holes 42*u* are formed in the upper surface of the metal sheet 80, and the bottomed holes 42*d* are formed in the lower surface of the metal sheet 80. The bottomed holes 42*u* and 42*d* partially overlap with each other in a plan view. The overlapped portions form the fine pores 42*z* connecting the bottomed holes 42*u* and 42*d* to each other. For example, a ferric chloride solution may be used to etch the metal sheet 80.

In the step illustrated in FIG. 7E, the resist layers 81 and 82 are removed using a stripping solution. The steps described above obtain the metal layer 62 that is illustrated in FIG. 5 and used as the intermediate metal layer 42 illustrated in FIG. 2. The metal layer 62 that is used as the intermediate metal layer 45 illustrated in FIG. 2 is also formed through the same steps as the steps illustrated in FIGS. 7A to 7E.

The method for forming the bottomed holes 43*u*, 43*d*, 44*u*, and 44*d* of the porous body 14*s* (43*s*, 44*s*) and the flow passages 14*r* (through holes 43X and 44X) will now be described.

FIGS. 8A to 8E are cross-sectional views illustrating the steps of forming a portion of the metal layer 63 (here, intermediate metal layer 43) illustrated in FIG. 6 corresponding to the liquid pipe 14.

Figures 8A, 8B, 8C, 8D, 8E:
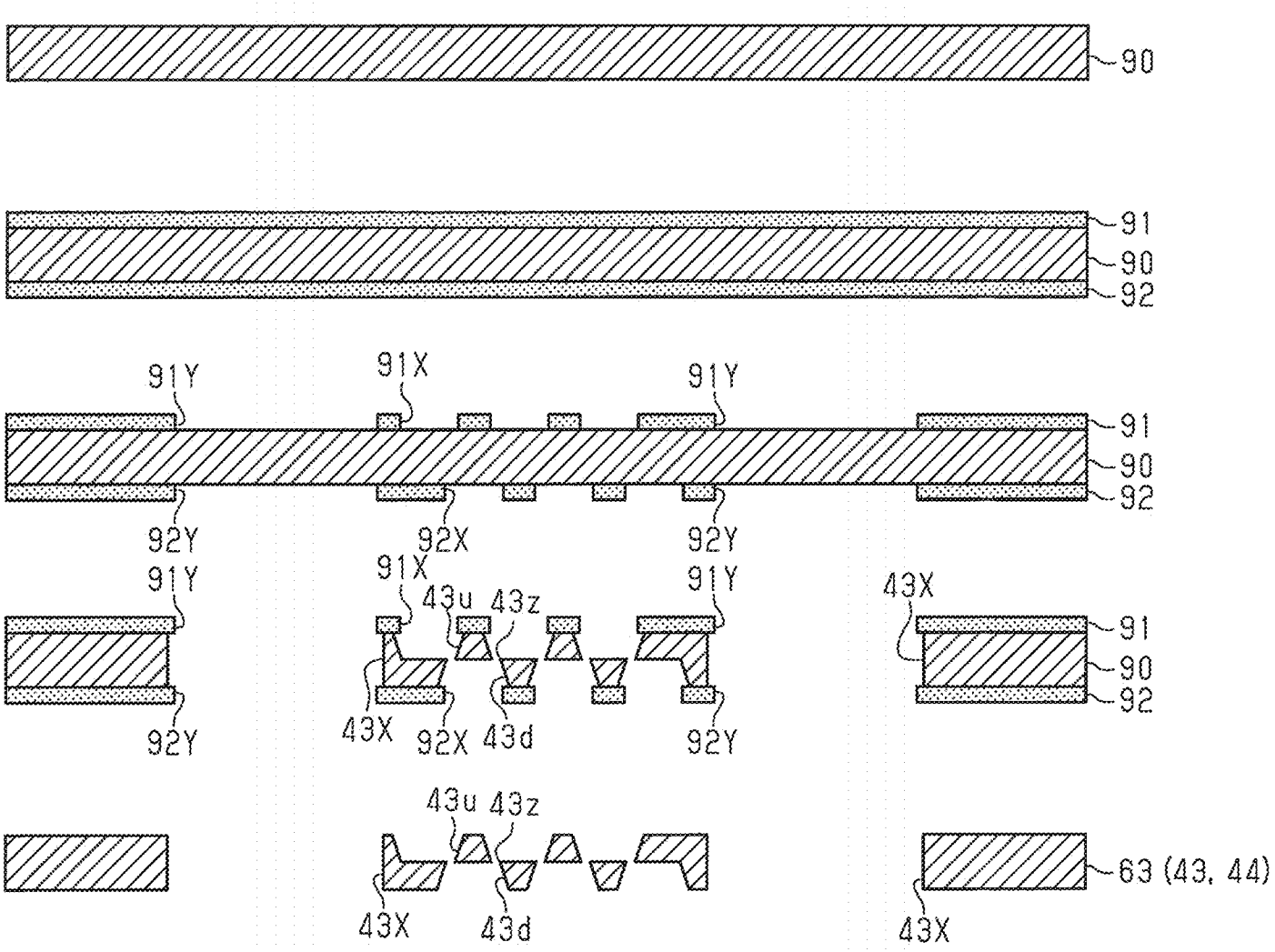
FIGS. 8A to 8E are schematic cross-sectional views illustrating the steps of manufacturing a lowermost metal layer.

In the step illustrated in FIG. 8A, a flat metal sheet 90 is prepared. The metal sheet 90 is a member that is ultimately used as the intermediate metal layer 43 and may be formed from, for example, copper, stainless steel, aluminum, or a magnesium alloy. The thickness of the metal sheet 90 may be, for example, approximately 50 μm to 200 μm.

In the step illustrated in FIG. 8B, a resist layer 91 is formed on the upper surface of the metal sheet 90, and a resist layer 92 is formed on the lower surface of the metal sheet 90. The resist layers 91 and 92 may be, for example, a photosensitive dry film resist.

In the step illustrated in FIG. 8C, the resist layer 91 is exposed and developed to form openings 91X and 91Y selectively exposing the upper surface of the metal sheet 90. In the same manner, the resist layer 92 is exposed and developed to form openings 92X and 92Y selectively exposing the lower surface of the metal sheet 90. The openings 91X and 92X are formed in conformance with the shapes and positions corresponding to the bottomed holes 43*u* and 43*d* illustrated in FIG. 2. The openings 91Y and 92Y are formed in conformance with the shapes and positions corresponding to the through holes 43X illustrated in FIG. 2.

In the step illustrated in FIG. 8D, the metal sheet 90 exposed in the openings 91X and 91Y is etched from the upper surface side, and the metal sheet 90 exposed in the openings 92X and 92Y is etched from the lower surface side. As a result, the bottomed holes 43*u* are formed in the upper surface of the metal sheet 90 at the positions of the openings 91X, and the bottomed holes 43*d* are formed in the lower surface of the metal sheet 90 at the positions of the openings 92X. The bottomed holes 43*u* and 43*d* partially overlap with each other. The overlapped portions form the fine pores 43*z* connecting the bottomed holes 43*u* and 43*d* to each other. The through holes 43X are formed in the positions of the openings 91Y and 92Y overlapping with each other in a plan view. For example, a ferric chloride solution may be used to etch the metal sheet 90.

In the step illustrated in FIG. 8E, the resist layers 91 and 92 are removed using a stripping solution. The steps described above obtain the metal layer 63 that is illustrated in FIG. 6 and used as the intermediate metal layer 43 illustrated in FIG. 2. The metal layer 63 that is used as the intermediate metal layer 44 illustrated in FIG. 2 is also formed through the same steps as the steps illustrated in FIGS. 8A to 8E.

The metal layer 61 that is solid and free from holes and grooves (refer to FIG. 4) is prepared.

Then, the uppermost metal layer 41 obtained from the metal layer 61 illustrated in FIG. 4, the intermediate metal layer 42 obtained from the metal layer 62 illustrated in FIG. 5, the intermediate metal layer 43 obtained from the metal layer 63 illustrated in FIG. 6, the intermediate metal layer 44 obtained from the metal layer 63 illustrated in FIG. 6, the intermediate metal layer 45 obtained from the metal layer 62 illustrated in FIG. 5, and the lowermost metal layer 46 obtained from the metal layer 61 illustrated in FIG. 4 are sequentially stacked.

As the metal layers 61 to 63 are heated at a predetermined temperature (for example, approximately 900° C.), the metal layers 61 to 63 are pressed so that the metal layers 61 to 63 are bonded through diffusion bonding. Subsequently, air is removed from, for example, the liquid pipe 14 using a vacuum pump (not illustrated), the working fluid C (e.g., water) is injected into the liquid pipe 14 from an inlet (not illustrated), and the inlet is closed.

The present embodiment has the advantages described below.

(1) The loop heat pipe 1 includes the evaporator 11 that vaporizes the working fluid C, the condenser 13 that liquefies the vapor Cv, the vapor pipe 12 that sends the vaporized working fluid (vapor Cv) to the condenser 13, and the liquid pipe 14 that sends the liquefied working fluid C to the evaporator 11. The liquid pipe 14 includes the porous bodies 14*s*, 42*t*, and 45*t* and the flow passages 14*r*. The flow passages 14*r* are surrounded by the porous bodies 14*s*, 42*t*, and 45*t* and the walls 14*w*. The capillary force of the porous bodies 14*s*, 42*t*, and 45*t* surrounding each flow passage 14*r* disperses the working fluid C flowing through the flow passage 14*r* into the porous bodies 14*s*, 42*t*, and 45*t*. This limits accumulation of the working fluid C in the flow passages 14*r*.

It should be apparent to those skilled in the art that the foregoing embodiments may be implemented in many other specific forms without departing from the scope of this disclosure. Particularly, it should be understood that the foregoing embodiments may be implemented in the following forms.

In the following modified examples, the same reference characters are given to those components that are the same as the corresponding components of the embodiment and other modified examples. Such components may not be described in detail. Each modified example described below and the embodiment described above (FIG. 1) have the same structure except for the liquid pipe. The same structure will not be illustrated in the drawings and described in detail.

Figure 9A:
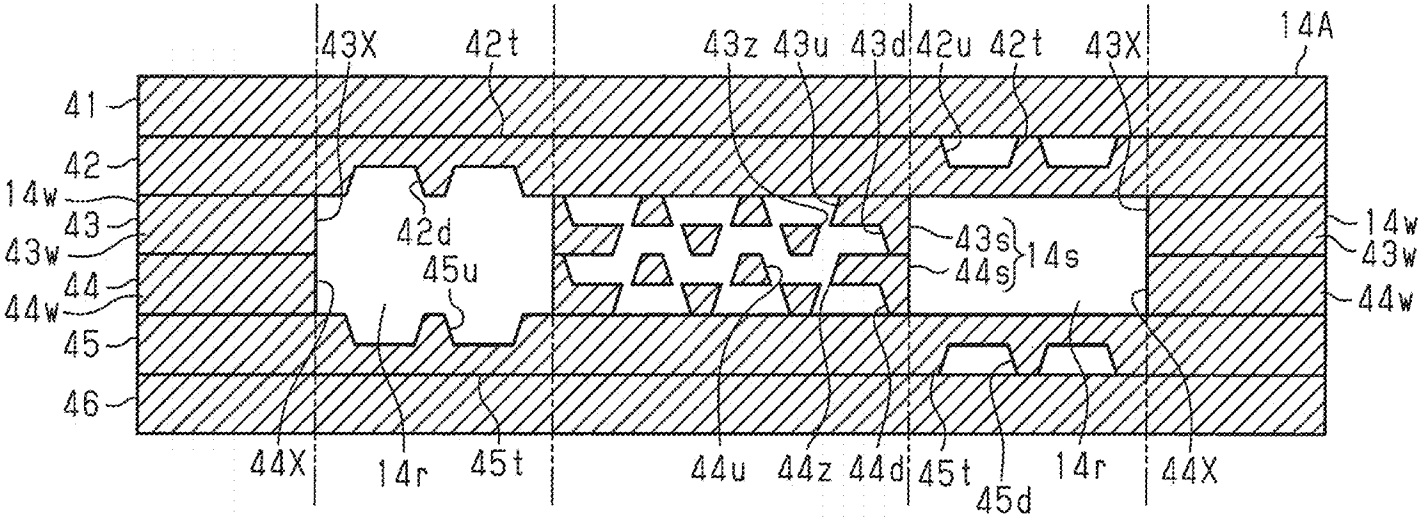
FIG. 9A is a schematic cross-sectional view illustrating a modified example of a liquid pipe.

FIG. 9A illustrates a liquid pipe 14A that is formed by the metal layer stack of the metal layers 41 to 46 and includes the two walls 14*w*, the porous bodies 14*s*, 42*t*, and 45*t*, and the two flow passages 14*r*.

The flow passages 14*r* are surrounded by the porous bodies 14*s* (43*s*, 44*s*), 42*t*, and 45*t* and the walls 14*w* (43*w*, 44*w*). In other words, the upper wall, the lower wall, and one side wall of each flow passage 14*r* are respectively defined by the porous bodies 42*t*, 45*t*, and 14*s* (43*s*, 44*s*). The other side wall of the flow passage 14*r* is defined by the wall 14*w*.

The porous body 14*s* includes the porous bodies 43*s* and 44*s* formed in the intermediate metal layers 43 and 44 of the metal layer stack of the metal layers 41 to 46. The porous bodies 43*s* and 44*s* are formed in the same manner as those formed in the liquid pipe 14 of the above embodiment (FIG. 2). The porous body 43*s* includes the bottomed holes 43*u* and 43*d*, and the porous body 44*s* includes the bottomed holes 44*u* and 44*d*.

Each flow passage 14*r* includes the through holes 43X and 44X extending through the intermediate metal layers 43 and 44 of the metal layers 41 to 46 in the thickness-wise direction. The through holes 43X and 44X are formed in the same manner as those formed in the liquid pipe 14 of the above embodiment (FIG. 2).

The intermediate metal layer 42 includes the porous bodies 42*t* immediately above the flow passages 14*r*. The porous bodies 42*t* include the bottomed holes 42*u* recessed from the upper surface of the intermediate metal layer 42 to a central portion of the metal layer 42 in the thickness-wise direction and the bottomed holes 42*d* recessed from the lower surface of the intermediate metal layer 42 to a central portion of the metal layer 42 in the thickness-wise direction.

Figure 9B:
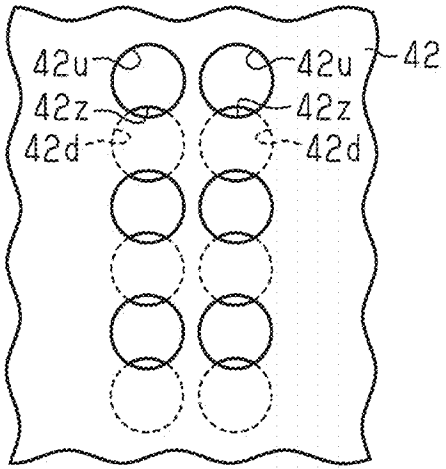
FIG. 9B is a partially schematic plan view of the liquid pipe of FIG. 9A illustrating a metal layer including a porous body.

FIG. 9B illustrates the bottomed holes 42*u* and 42*d* and the fine pores 42*z* formed in the metal layer 42 illustrated in FIG. 9A. The bottomed holes 42*u* and 42*d* are arranged in rows, and the bottomed holes 42*u* and 42*d* are alternately arranged in each row. The bottomed holes 42*u* are spaced apart and adjacent to one another in a direction (sideward direction in FIG. 9B) orthogonal to the direction of the rows (vertical direction in FIG. 9B, that is, direction in which the working fluid C flows from the condenser 13 toward the evaporator 11). In the same manner, the bottomed holes 42*d* are spaced apart and adjacent to one another in the direction orthogonal to the direction of the rows. The bottomed holes 42*u* and 42*d* are alternately arranged in the direction of the rows and overlap with each other in a plan view. The overlapped portions form the fine pores 42*z* connecting the bottomed holes 42*u* and 42*d* to each other. Preferably, each row extends in a direction in which the working fluid C flows. With the porous bodies 42*t* having the above configuration, the working fluid C flows in the porous bodies 42*t* in the direction of the rows through the bottomed holes 42*u* and 42*d*, which are alternately arranged in the direction of the rows, and the fine pores 42*z*, which connect the bottomed holes 42*u* and 42*d* to each other through the overlapped portions.

Figure 10A:
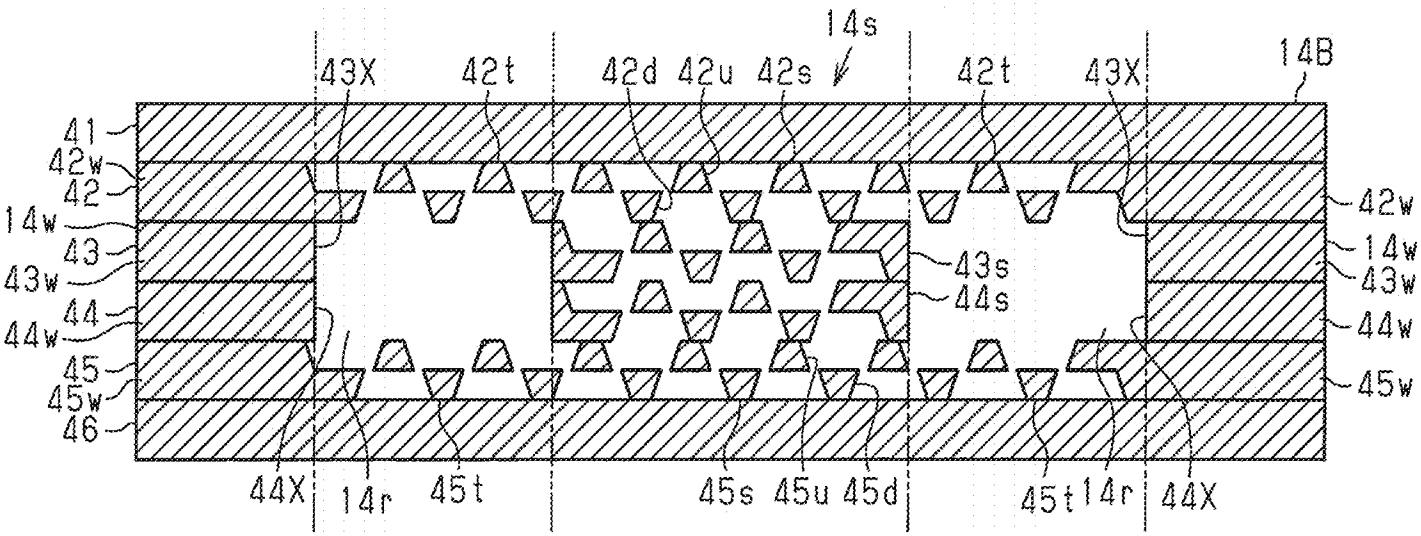
FIGS. 10A, 10B, 11A, 11B, 12A, 12B, and 13 are schematic plan views illustrating various modified examples of liquid pipes.

FIG. 10A illustrates a liquid pipe 14B that is formed by the metal layer stack of the metal layers 41 to 46 and includes the two walls 14*w*, the porous bodies 14*s*, 42*t*, and 45*t*, and the two flow passages 14*r*.

The porous body 14*s* is formed in the intermediate metal layers 42 to 45, which exclude the uppermost metal layer 41 and the lowermost metal layer 46. In the example illustrated in FIG. 10A, the porous body 14*s* includes porous bodies 42*s*, 43*s*, 44*s*, and 45*s* formed in the intermediate metal layers 42 to 45. Each flow passage 14*r* includes the through holes 43X and 44X formed in the intermediate metal layers 43 and 44.

The flow passages 14*r* are surrounded by the porous bodies 14*s* (43*s*, 44*s*), 42*t*, and 45*t* and the walls 14*w* (43*w*, 44*w*). In other words, the upper wall, the lower wall, and one side wall of each flow passage 14*r* are defined by the porous bodies 42*t*, 45*t*, and 14*s* (43*s*, 44*s*). The other side wall of the flow passage 14*r* is defined by the wall 14*w*.

The intermediate metal layer 42 includes the two porous bodies 42*t* immediately above the through holes 43X (flow passages 14*r*) and the porous body 42*s* located between the two porous bodies 42*t*. The porous body 42*s* is in communication with the porous bodies 42*t* and the porous body 43*s* of the intermediate metal layer 43. In the same manner as the porous bodies 42*t*, the porous body 42*s* includes the bottomed holes 42*u* recessed from the upper surface of the intermediate metal layer 42, the bottomed holes 42*d* recessed from the lower surface of the intermediate metal layer 42, and the fine pores 42*z* connecting the bottomed holes 42*u* and 42*d*. Thus, the intermediate metal layer 42 is entirely formed as a porous body except for the walls 42*w* located at the two ends. The porous bodies 42*t* may or may not be distinguished from the porous body 42*s*.

The intermediate metal layer 45 includes the two porous bodies 45*t* immediately below the through holes 44X (flow passages 14*r*) and a porous body 45*s* located between the two porous bodies 45*t*. The porous body 45*s* is in communication with the porous bodies 45*t* and the porous body 44*s* of the intermediate metal layer 44. In the same manner as the porous bodies 45*t*, the porous body 45*s* includes the bottomed holes 45*u* recessed from the upper surface of the intermediate metal layer 45, the bottomed holes 45*d* recessed from the lower surface of the intermediate metal layer 45, and the fine pores 45*z* connecting the bottomed holes 45*u* and 45*d*. Thus, the intermediate metal layer 45 is entirely formed as a porous body except for the walls 45*w* located at the two ends. The porous bodies 45*t* may or may not be distinguished from the porous body 45*s*.

The liquid pipe 14B having the above configuration includes a large amount of pours bodies (14*s* (42*s* to 45*s*), 42*t*, 45*t*) contacting or surrounding the flow passages 14*r* and thus is capable of transferring a large amount of the working fluid C. Also, the large amount of porous bodies (14*s* (42*s* to 45*s*), 42*t*, 45*t*) contacting or surrounding the flow passages 14*r* allows further dispersion of the working fluid C and further limits a liquid accumulation. Thus, deformation and breakage of the liquid pipe 14B are further limited, for example, in a thermal cycle test.

Figure 10B:
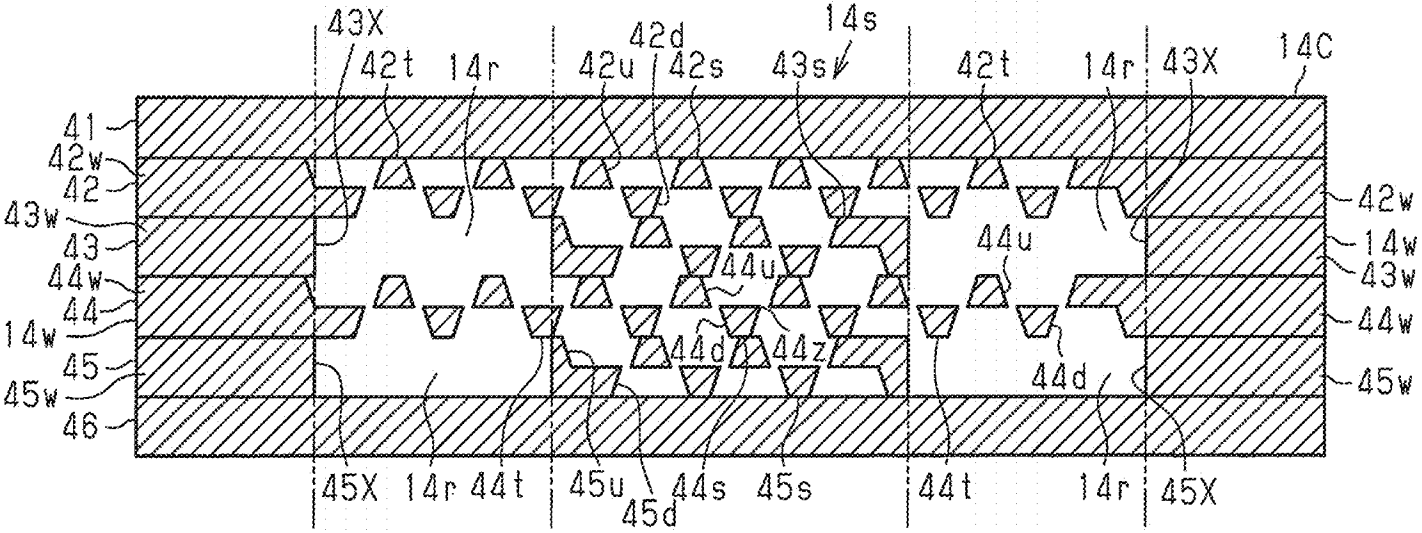

FIG. 10B illustrates a liquid pipe 14C that is formed by the metal layer stack of the metal layers 41 to 46 and includes the two walls 14*w*, the porous bodies 14*s*, 42*t*, and 44*t*, and four flow passages 14*r*.

The porous body 14*s* is formed in the intermediate metal layers 42 to 45, which exclude the uppermost metal layer 41 and the lowermost metal layer 46. In the example illustrated in FIG. 10B, the porous body 14*s* includes the porous bodies 42*s*, 43*s*, 44*s*, and 45*s* formed in the intermediate metal layers 42 to 45. Each flow passage 14*r* includes a through hole 43X extending through the intermediate metal layer 43 in the thickness-wise direction or a through hole 45X extending through the intermediate metal layer 45 in the thickness-wise direction.

Thus, each flow passage 14*r* (through hole 43X) in the intermediate metal layer 43 is surrounded by the porous bodies 14*s* (43*s*), 42*t*, and 44*t* and the wall 14*w* (43*w*). In other words, the upper wall, the lower wall, and one side wall of the flow passage 14*r* in the intermediate metal layer 43 are defined by the porous bodies 42*t*, 44*t*, and 14*s* (43*s*). The other side wall of the flow passage 14*r* is defined by the wall 14*w* (43*w*).

Also, each flow passage 14*r* (through hole 45X) in the intermediate metal layer 45 is surrounded by the porous bodies 14*s* (45*s*) and 44*t*, the wall 14*w* (45*w*), and the upper surface of the lowermost metal layer 46. In other words, the upper wall and one side wall of the flow passage 14*r* in the intermediate metal layer 45 are defined by the porous bodies 44*t* and 14*s* (45*s*). The other side wall of the flow passage 14*r* is defined by the wall 14*w* (45*w*). The lower wall of the flow passage 14*r* is defined by the upper surface of the lowermost metal layer 46.

The intermediate metal layer 42 includes the two porous bodies 42*t* immediately above the through holes 43X (flow passages 14*r*) and the porous body 42*s* located between the two porous bodies 42*t*. The porous body 42*s* is in communication with the porous bodies 42*t* and the porous body 43*s* of the intermediate metal layer 43. The porous bodies 42*t* are in communication with the through holes 43X (flow passages 14*r*) of the intermediate metal layer 43. The intermediate metal layer 42 is entirely formed as a porous body except for the walls 42*w* located at the two ends.

The intermediate metal layer 43 includes the two through holes 43X extending through in the thickness-wise direction, the two walls 43*w* located at an outer side of the through holes 43X, and the porous body 43*s* located between the two through holes 43X. Each through hole 43X is in communication with at least one of the bottomed holes 43*u* and 43*d* via a portion of the side surface of the porous body 43*s* adjacent to the through hole 43X.

The intermediate metal layer 44 includes two porous bodies 44*t* immediately above the through holes 45X (flow passages 14*r*) and the porous body 44*s* located between the two porous bodies 44*t*. In the same manner as the porous bodies 44*t*, the porous body 44*s* includes the bottomed holes 44*u* recessed from the upper surface of the intermediate metal layer 44, the bottomed holes 44*d* recessed from the lower surface of the intermediate metal layer 44, and the fine pores 44*z* connecting the bottomed holes 44*u* and 44*d* to each other. Thus, the intermediate metal layer 44 is entirely formed as a porous body except for the walls 44*w* located at the two ends.

The porous body 44*s* is in communication with the porous bodies 44*t* and the porous bodies 43*s* and 45*s* of the intermediate metal layers 43 and 45. The porous bodies 44*t* are in communication with the through holes 43X (flow passages 14*r*) of the intermediate metal layer 43 and the through holes 45X (flow passages 14*r*) of the intermediate metal layer 45. For example, the bottomed holes 44*u* of the intermediate metal layer 44 are in communication with the through holes 43X (flow passages 14*r*) of the intermediate metal layer 43, and the bottomed holes 44*d* of the intermediate metal layer 44 are in communication with the through holes 45X (flow passages 14*r*) of the intermediate metal layer 45.

The intermediate metal layer 45 includes the two through holes 45X extending through in the thickness-wise direction, the two walls 45*w* located at an outer side of the through holes 45X, and the porous body 45*s* located between the two through holes 45X. Each through hole 45X is in communication with at least one of the bottomed holes 45*u* and 45*d* via a portion of the side surface of the porous body 45*s* adjacent to the through hole 45X.

The liquid pipe 14C having the above configuration includes a large amount of porous bodies (14*s* (42*s* to 45*s*), 42*t*, 44*t*) contacting or surrounding the flow passages 14*r* and thus is capable of transferring a large amount of the working fluid C. Also, the large amount of porous bodies (14*s* (42*s* to 45*s*), 42*t*, 44*t*) contacting or surrounding the flow passages 14*r* allows further dispersion of the working fluid C and limits a liquid accumulation. Thus, deformation and breakage of the liquid pipe 14C are further limited, for example, in a thermal cycle test.

Figure 11A:
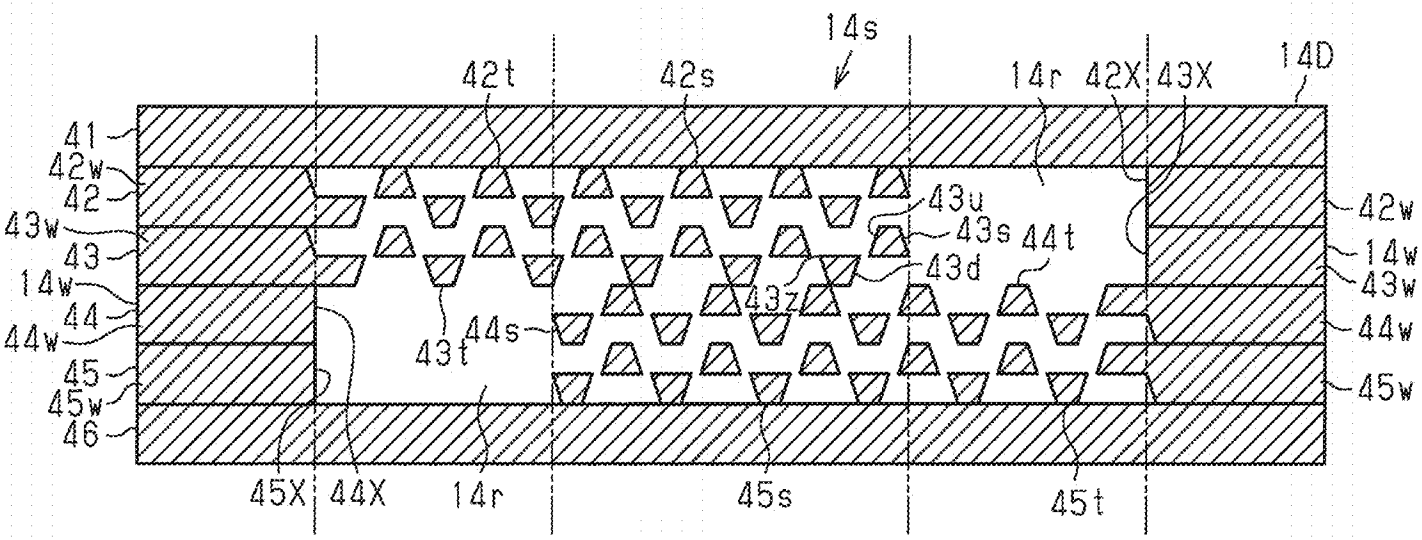

FIG. 11A illustrates a liquid pipe 14D that is formed by the metal layer stack of the metal layers 41 to 46 and includes the two walls 14*w*, the porous bodies 14*s*, 42*t*, 43*t*, 44*t*, and 45*t*, and the two flow passages 14*r*.

The porous body 14*s* is formed in the intermediate metal layers 42 to 45, which exclude the uppermost metal layer 41 and the lowermost metal layer 46. In the example illustrated in FIG. 11A, the porous body 14*s* includes the porous bodies 42*s*, 43*s*, 44*s*, and 45*s* formed in the intermediate metal layers 42 to 45. Each flow passage 14*r* includes through holes 42X and 43X extending through the intermediate metal layers 42 and 43 in the thickness-wise direction or the through holes 44X and 45X extending through the intermediate metal layers 44 and 45 in the thickness-wise direction. The through holes 42X and 43X do not overlap with the through holes 44X and 45X in a plan view.

The intermediate metal layers 42 and 43 respectively include the porous bodies 42*t* and 43*t* in positions overlapping with the through holes 44X and 45X of the intermediate metal layers 44 and 45. The intermediate metal layers 44 and 45 respectively include the porous bodies 44*t* and 45*t* in positions overlapping with the through holes 42X and 43X of the intermediate metal layers 42 and 43. The intermediate metal layers 42 to 45 include the porous bodies 42*s*, 43*s*, 44*s*, and 45*s* at positions overlapping with each other.

In the same manner as the porous body 43*t*, the porous body 43*s* of the intermediate metal layer 43 includes the bottomed holes 43*u* recessed from the upper surface of the intermediate metal layer 43, the bottomed holes 43*d* recessed from the lower surface of the intermediate metal layer 43, and the fine pores 43*z* connecting the bottomed holes 43*u* and 43*d* to each other.

The flow passage 14*r* that includes the through holes 42X and 43X is surrounded by the porous bodies 14*s* (42*s*, 43*s*) and 44*t*, the wall 14*w* (42*w*, 43*w*), and the lower surface of the uppermost metal layer 41. In other words, the lower wall and one side wall of the flow passage 14*r* including the through holes 42X and 43X are defined by the porous bodies 44*t* and 14*s* (42*s*, 43*s*). The other side wall of the flow passage 14*r* is defined by the wall 14*w* (42*w*, 43*w*). The upper wall of the flow passage 14*r* is defined by the lower surface of the uppermost metal layer 41.

The flow passage 14*r* that includes the through holes 44X and 45X is surrounded by the porous bodies 14*s* (44*s*, 45*s*) and 43*t*, the wall 14*w* (44*w*, 45*w*), and the upper surface of the lowermost metal layer 46. In other words, the upper wall and one side wall of the flow passage 14*r* including the through holes 44X and 45X are defined by the porous bodies 43*t* and 14*s* (44*s*, 45*s*). The other side wall of the flow passage 14*r* is defined by the wall 14*w* (44*w*, 44*w*). The lower wall of the flow passage 14*r* is defined by the upper surface of the lowermost metal layer 46.

The liquid pipe 14D having the above configuration includes a large amount of porous bodies (14*s* (42*s* to 45*s*) and 42*t* to 45*t*) contacting and surrounding the flow passages 14*r* and thus is capable of transferring a large amount of the working fluid C. Also, the large amount of porous bodies (14*s* (42*s* to 45*s*) and 42*t* to 45*t*) contacting or surrounding the flow passages 14*r* allows further dispersion of the working fluid C and further limits a liquid accumulation. Thus, deformation and breakage of the liquid pipe 14D are further limited, for example, in a thermal cycle test.

Figure 11B:
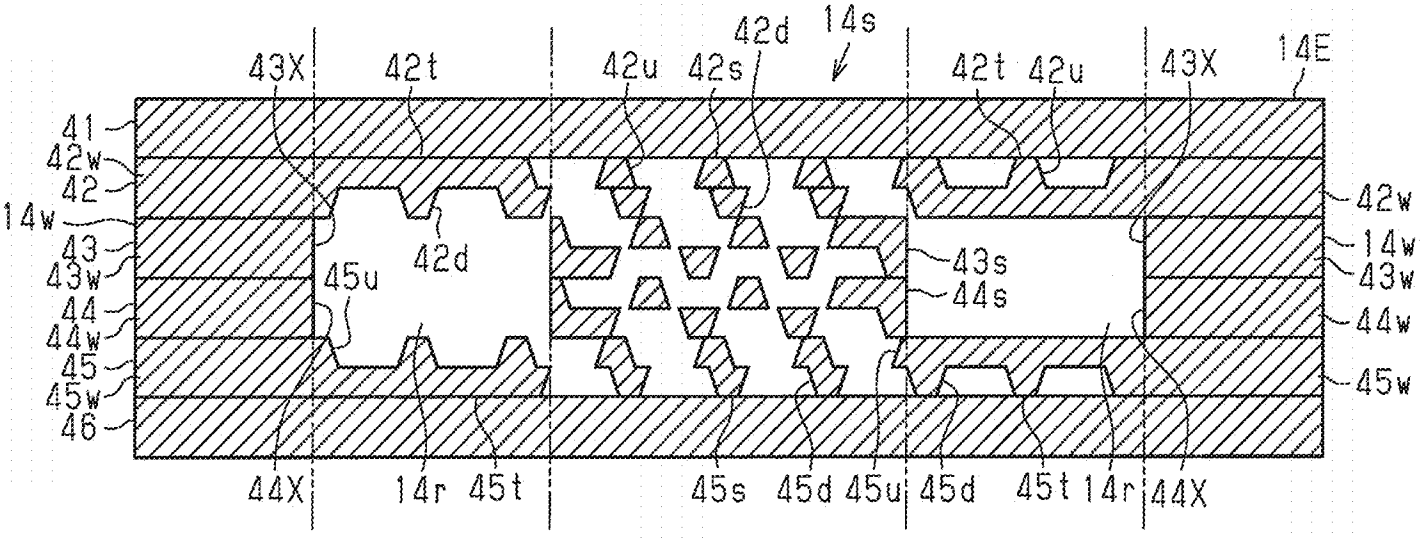

FIG. 11B illustrates a liquid pipe 14E that is formed by the metal layer stack of the metal layers 41 to 46 and includes the two walls 14*w*, the porous bodies 14*s*, 42*t*, and 45*t*, and the two flow passages 14*r*. The liquid pipe 14E differs from the liquid pipe 14A illustrated in FIG. 9A in that the metal layers 42 and 45 include the porous bodies 42*s* and 45*s*.

That is, the porous body 14*s* includes the porous bodies 42*s*, 43*s*, 44*s*, and 45*s* formed in the intermediate metal layers 42 to 45, which exclude the uppermost metal layer 41 and the lowermost metal layer 46.

Each flow passage 14*r* includes the through holes 43X and 44X of the intermediate metal layers 43 and 44. The flow passages 14*r* are surrounded by the porous bodies 14*s* (43*s*, 44*s*), 42*t*, and 45*t* and the walls 14*w* (43*w*, 44*w*). In other words, the upper wall, the lower wall, and one side wall of the flow passages 14*r* are defined by the porous bodies 42*t*, 45*t*, and 14*s* (43*s*, 44*s*). The other side wall of the flow passages 14*r* is defined by the walls 14*w* (43*w*, 44*w*).

The intermediate metal layer 42 includes the two porous bodies 42*t* immediately above the through holes 43X (flow passages 14*r*) and the porous body 42*s* located between the two porous bodies 42*t*. In the same manner as in FIG. 9B, the bottomed holes 42*u* and 42*d* in the porous bodies 42*t* are arranged in rows, and the bottomed holes 42*u* and 42*d* are alternately arranged in each row. Preferably, each row extends in a direction in which the working fluid C flows.

The intermediate metal layer 43 includes the two through holes 43X and the porous body 43*s* located between the two through holes 43X. The intermediate metal layer 44 includes the two through holes 44X and the porous body 44*s* located between the two through holes 44X.

The intermediate metal layer 45 includes the two porous bodies 45*t* immediately below the through holes 44X (flow passages 14*r*) and the porous body 45*s* located between the two porous bodies 45*t*. In the same manner as in FIG. 9B, the bottomed holes 45*u* and 45*d* in the porous bodies 45*t* are arranged in rows, and the bottomed holes 45*u* and 45*d* are alternately arranged in each row. Preferably, each row extends in a direction in which the working fluid C flows.

The liquid pipe 14E having the above configuration includes a large amount of porous bodies (14*s* (42*s* to 44*s*), 42*t*, 45*t*) contacting or surrounding the flow passages 14*r* and thus is capable of transferring a large amount of the working fluid C. Also, the large amount of porous bodies (14*s* (42*s* to 44*s*), 42*t*, 45*t*) contacting or surrounding the flow passages 14*r* allows further dispersion of the working fluid C and limits a liquid accumulation. Thus, deformation and breakage of the liquid pipe 14E are further limited, for example, in a thermal cycle test. Additionally, the bottomed holes 42*u* and 42*d* are arranged in rows in the porous bodies 42*t* immediately above the flow passages 14*r*, and the bottomed holes 45*u* and 45*d* are arranged in rows in the porous bodies 45*t* immediately below the flow passages 14*r*. This allows the working fluid C to smoothly move along the flow passages 14*r*.

Figure 12A:
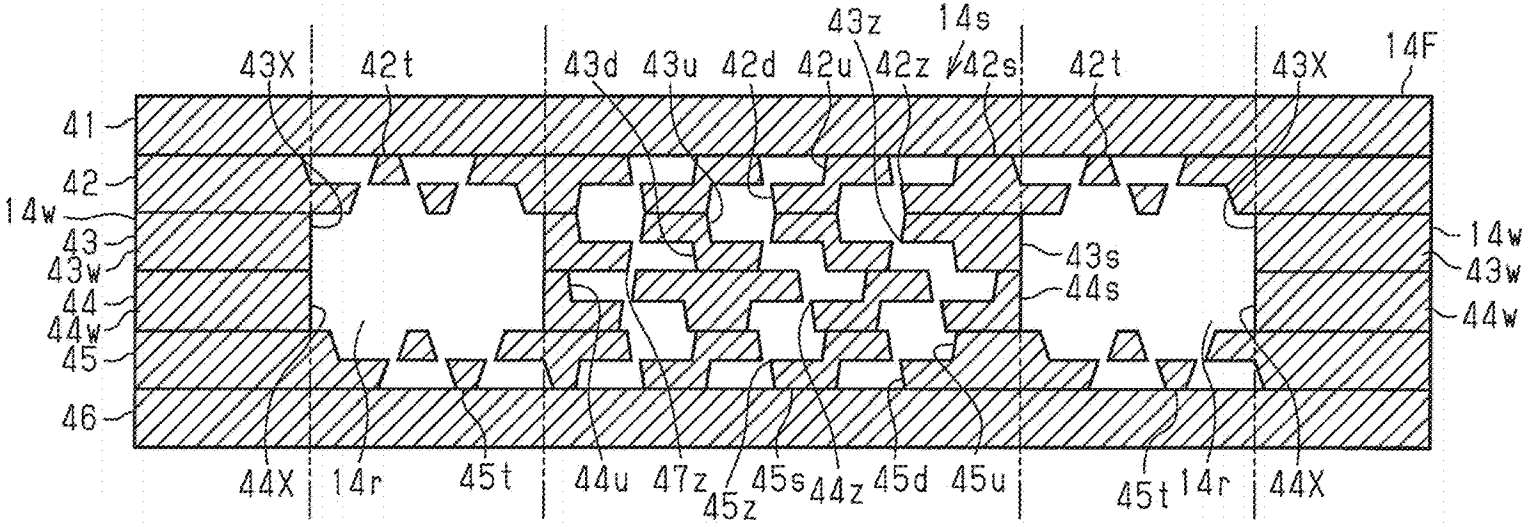

FIG. 12A illustrates a liquid pipe 14F that is formed by the metal layer stack of the metal layers 41 to 46 and includes the two walls 14*w*, the porous bodies 14*s*, 42*t*, and 45*t*, and the two flow passages 14*r*.

The porous body 14*s* is formed in the intermediate metal layers 42 to 45, which exclude the uppermost metal layer 41 and the lowermost metal layer 46. In the example illustrated in FIG. 12A, the porous body 14*s* includes the porous bodies 42*s*, 43*s*, 44*s*, and 45*s* formed in the intermediate metal layers 42 to 45. Each flow passage 14*r* includes the through holes 43X and 44X formed in the intermediate metal layers 43 and 44.

The flow passages 14*r* are surrounded by the porous bodies 14*s* (43*s*, 44*s*), 42*t*, and 45*t* and the walls 14*w* (43*w*, 44*w*). In other words, the upper wall, the lower wall, and one side wall of the flow passages 14*r* are defined by the porous bodies 42*t*, 45*t*, and 14*s* (43*s*, 44*s*). The other side wall of the flow passages 14*r* is defined by the walls 14*w* (43*w*, 44*w*).

The intermediate metal layer 42 includes the two porous bodies 42*t* immediately above the through holes 43X (flow passages 14*r*) and the porous body 42*s* located between the two porous bodies 42*t*. The intermediate metal layer 43 includes the two through holes 43X and the porous body 43*s* located between the two through holes 43X. The intermediate metal layer 44 includes the two through holes 44X and the porous body 44*s* located between the through holes 44X. The intermediate metal layer 45 includes the two porous bodies 45*t* immediately below the through holes 44X (flow passages 14*r*) and the porous body 45*s* located between the two porous bodies 45*t*.

The bottomed holes 42*d* of the porous body 42*s* overlap with the bottomed holes 43*u* of the porous body 43*s* in a plan view. In this case, the area of contact between the intermediate metal layers 42 and 43 stacked on each other is increased. Thus, the intermediate metal layers 42 and 43 are strongly bonded.

The bottomed holes 43*d* of the porous body 43*s* partially overlap with the bottomed holes 44*u* of the porous body 44*s* in a plan view. The overlapped portions form fine pores 47*z* connecting the bottomed holes 43*d* and 44*u* to each other. As described above, the metal layers 42 to 45 include the fine pores 42*z* to 45*z*, and the interface of two stacked metal layers (e.g., metal layers 43 and 44) includes the fine pores 47*z*. This increases the total number of fine pores and increases the capillary force generated by the fine pores.

The liquid pipe 14F having the above configuration includes a large amount of porous bodies (14*s* (42*s* to 45*s*), 42*t*, 45*t*) contacting or surrounding the flow passages 14*r* and thus is capable of transferring a large amount of the working fluid C. Also, the large amount of porous bodies (14*s* (42*s* to 45*s*), 42*t*, 45*t*) contacting or surrounding the flow passages 14*r* allows further dispersion of the working fluid C and limits a liquid accumulation. Thus, deformation and breakage of the liquid pipe 14F are further limited, for example, in a thermal cycle test.

The stacking structure of the intermediate metal layers 42 to 45 is not limited to the structure illustrated in FIG. 12A. The intermediate metal layers 42 to 45 may be stacked so that upper bottomed holes overlap with lower bottomed holes in each or some of the interfaces of the intermediate metal layers 42 to 45. Alternatively, the intermediate metal layers 42 to 45 may be stacked so that fine pores are formed in each or some of the interfaces of the intermediate metal layers 42 to 45.

Figure 12B:
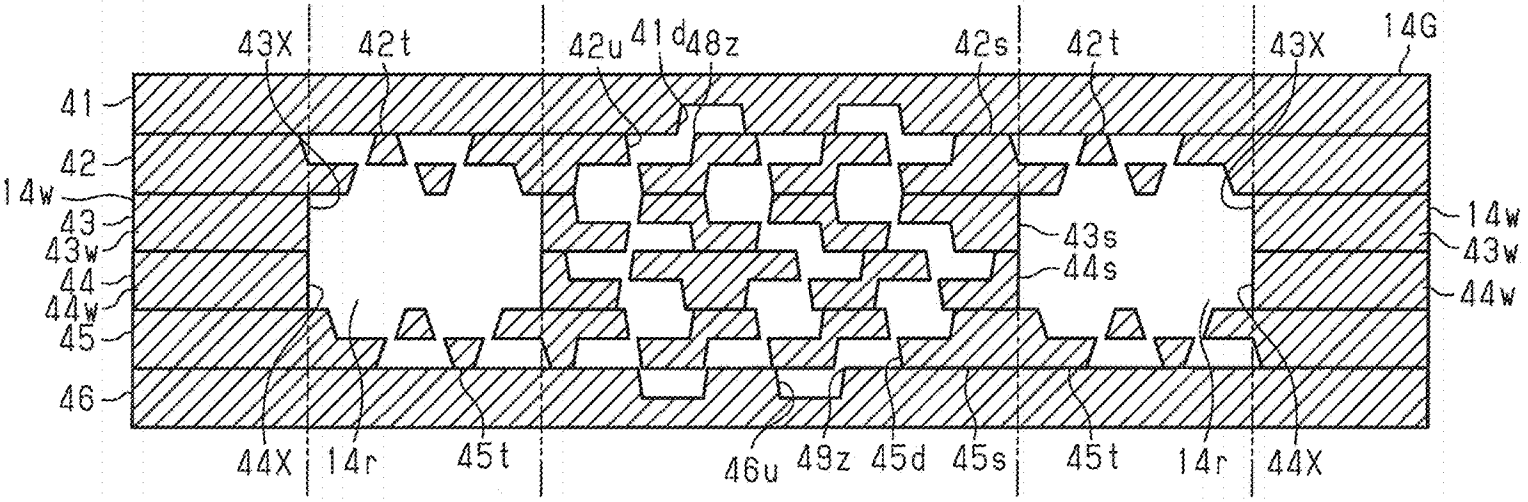

FIG. 12B illustrates a liquid pipe 14G that is formed by the metal layer stack of the metal layers 41 to 46. The intermediate metal layers 42 to 45 of the liquid pipe 14G are formed in the same manner as the intermediate metal layers 42 to 45 of the liquid pipe 14F illustrated in FIG. 12A.

The uppermost metal layer 41 includes bottomed holes 41*d* recessed from the lower surface to a central portion of the metal layer 41 in the thickness-wise direction. In a plan view, the bottomed holes 41*d* partially overlap with the bottomed holes 42*u* of the intermediate metal layer 42 adjacent to the uppermost metal layer 41. Thus, the interface of the uppermost metal layer 41 and the intermediate metal layer 42 includes fine pores 48*z* connecting the bottomed holes 41*d* and 42*u* to each other.

The lowermost metal layer 46 includes bottomed holes 46*u* recessed from the upper surface to a central portion of the metal layer 46 in the thickness-wise direction. In a plan view, the bottomed holes 46*u* partially overlap with the bottomed holes 45*d* of the intermediate metal layer 45 adjacent to the lowermost metal layer 46. Thus, the interface of the lowermost metal layer 46 and the intermediate metal layer 45 includes fine pores 49*z* connecting the bottomed holes 46*u* and 45*d* to each other.

As described above, in the liquid pipe 14G, the uppermost metal layer 41 and the lowermost metal layer 46 respectively include the bottomed holes 41*d* and 46*u*. This increases the amount of porous bodies and transfers a large amount of the working fluid C. Additionally, the large amount of porous bodies allows further dispersion of the working fluid C and further limits a liquid accumulation. Thus, deformation and breakage of the liquid pipe 14G are further limited, for example, in a thermal cycle test.

Figure 13:
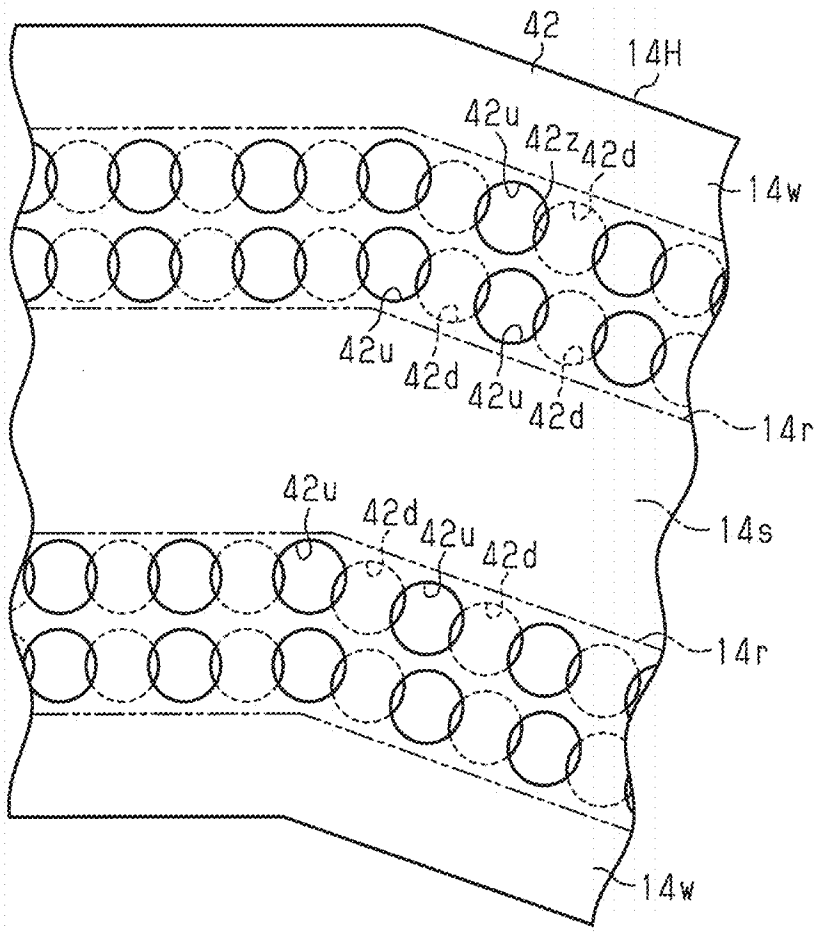

FIG. 13 illustrates a bent liquid pipe 14H. The intermediate metal layer 42 of the liquid pipe 14H includes the bottomed holes 42*u* and 42*d*. The bottomed holes 42*u* and 42*d* are alternately arranged along the bent liquid pipe 14H and partially overlap with each other forming the fine pores 42*z*. This allows the working fluid C to smoothly move along the bent the liquid pipe 14H. The working fluid C readily flows, for example, even in an orthogonally bent portion of the liquid pipe 14H (for example, upper right bent portion of the loop heat pipe 1 in FIG. 1). Although not illustrated in the drawings, the intermediate metal layers 43 to 45 may also include porous bodies and flow passages that are bent along the liquid pipe 14H.

Further modified examples applicable to the above-described embodiment and modified examples will be described below.

Figure 14A:
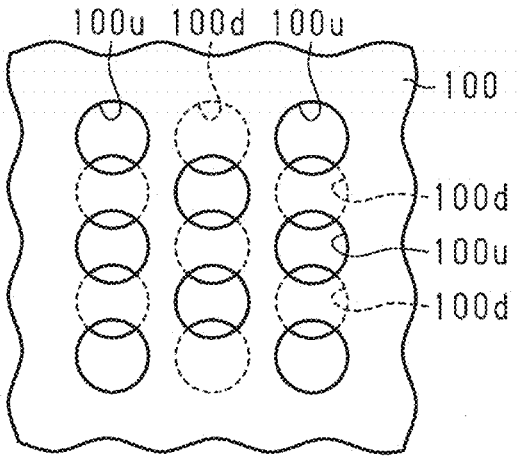
FIGS. 14A and 14B are partially schematic plan views of metal layers including porous bodies according to various modified examples.

FIG. 14A illustrates a metal layer 100 having a modified example of a porous structure applicable instead of the metal layers 42 to 45. The metal layer 100 includes bottomed holes 100*u* and 100*d*. The bottomed holes 100*u* are formed in the upper surface of the metal layer 100, and the bottomed holes 100*d* are formed in the lower surface of the metal layer 100. The bottomed holes 100*u* and 100*d* are arranged in rows. The bottomed holes 100*u* and 100*d* are alternately arranged in each row. Additionally, the bottomed holes 100*u* and 100*d* are alternately arranged in a direction (sideward direction in FIG. 14A) orthogonal to the direction of the rows.

Figure 14B:
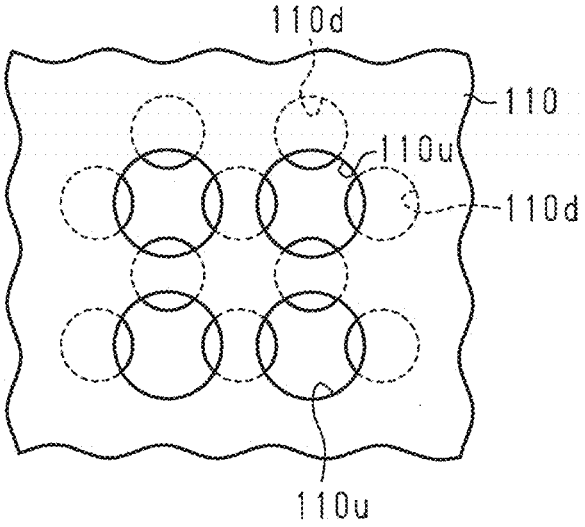

FIG. 14B illustrates a metal layer 110 having another modified example of a porous structure applicable instead of the metal layers 42 to 45. The metal layer 110 includes bottomed holes 110*u* and 110*d* having different sizes. In the example illustrated in FIG. 14B, the bottomed holes 110*u* are larger than the bottomed holes 110*d*. However, the bottomed holes 110*d* may be larger than the bottomed holes 110*u*. The bottomed holes 110*u* and 110*d* having different sizes may be used as bottomed holes that are adjacent to each other between two metal layers. The arrangement of the bottomed holes 110*u* and 110*d* may be changed.

Figure 15A:
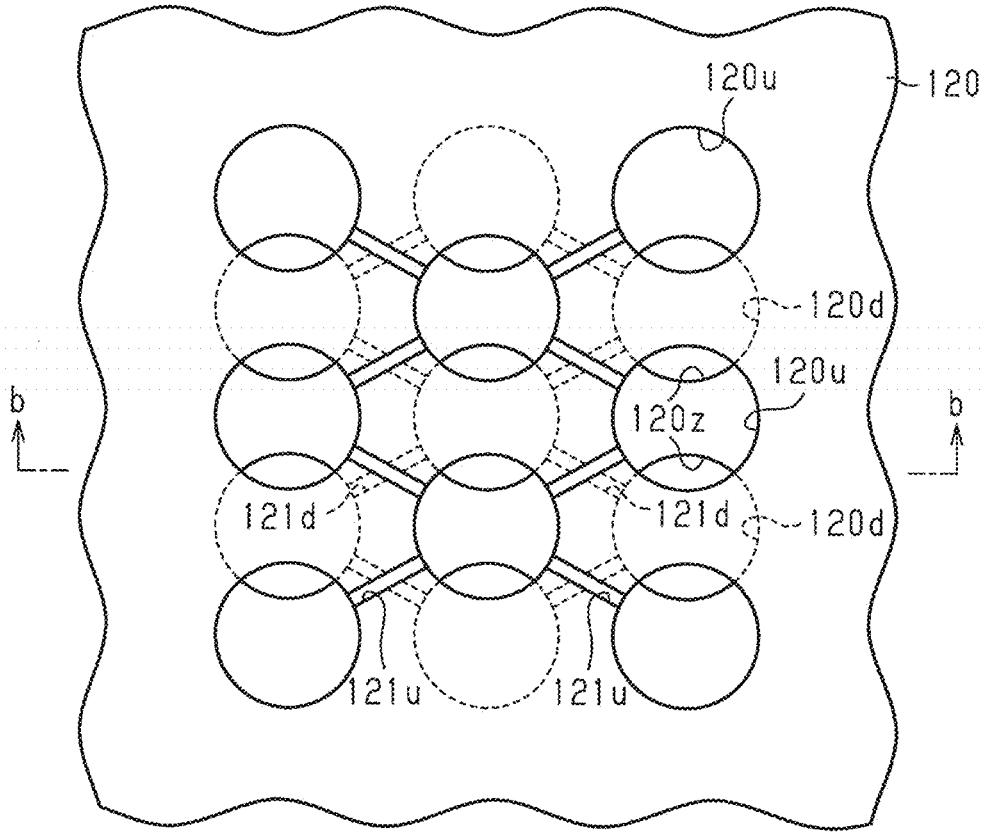
FIG. 15A is a partially schematic plan view of a metal layer including a porous body according to another modified example.
Figure 15B:
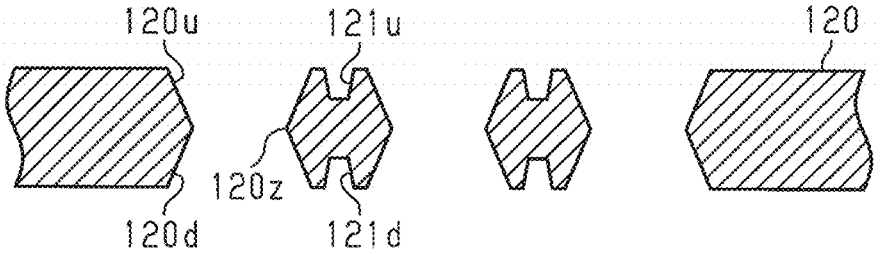
FIG. 15B is a cross-sectional view taken along line b-b in FIG. 15A.

FIGS. 15A and 15B illustrate a metal layer 120 having another modified example of a porous structure applicable instead of the metal layers 42 to 45. The metal layer 120 includes bottomed holes 120*u* and 120*d* and grooves 121*u* and 121*d*. FIG. 15B is a cross-sectional view taken along line b-b in FIG. 15A.

The bottomed holes 120*u* are recessed from the upper surface to a central portion of the metal layer 120 in the thickness-wise direction, and the bottomed holes 120*d* are recessed from the lower surface to a central portion of the metal layer 120 in the thickness-wise direction. The bottomed holes 120*u* and 120*d* are arranged in rows and alternately arranged in each row. The bottomed holes 120*u* and 120*d* that are alternately arranged in the direction of the rows (vertical direction in FIG. 15A) partially overlap with each other. The overlapped portions form fine pores 120*z* connecting the bottomed holes 120*u* and 120*d* to each other. Additionally, the bottomed holes 120*u* and 120*d* are alternately arranged in a direction orthogonal to the direction of the rows (sideward direction in FIG. 15A).

The grooves 121*u* are formed in the upper surface of the metal layer 120. Each groove 121*u* connects two bottomed holes 120*u* located close to the groove 121*u*. The grooves 121*d* are formed in the lower surface of the metal layer 120. Each groove 121*d* connects two bottomed holes 120*d* located close to the groove 121*d*.

The bottomed holes 120*u* and 120*d* that are alternately arranged in the direction of the rows (vertical direction in FIG. 15A) allow the working fluid C to move in the direction of the rows. Each groove 121*u* formed in the upper surface of the metal layer 120 allows the working fluid C to move between the two bottomed holes 120*u* connected by the groove 121*u*. In the same manner, each groove 121*d* formed in the lower surface of the metal layer 120 allows the working fluid C to move between the two bottomed holes 120*d* connected by the groove 121*d*. Thus, the grooves 121*u* (121*d*) allow the working fluid C to move in a direction differing form the direction in which the bottomed holes 120*u* (120*d*) and the bottomed holes 120*u* (120*d*) are alternately arranged.

The grooves 121*u* (121*d*) having the above configuration may be formed in the metal layers 42 to 45 of the above-described embodiment and modified examples or in at least one of the uppermost metal layer 41 and the lowermost metal layer 46 of the modified example illustrated in FIG. 12B.

Figure 16A:
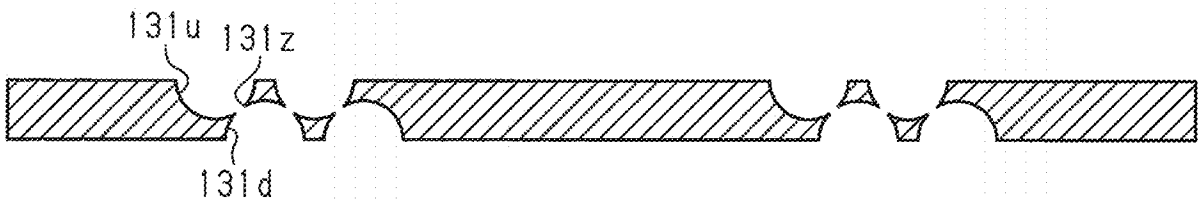
FIGS. 16A and 16B are schematic cross-sectional views illustrating metal layers including bottomed holes according to various modified examples.
Figure 16B:
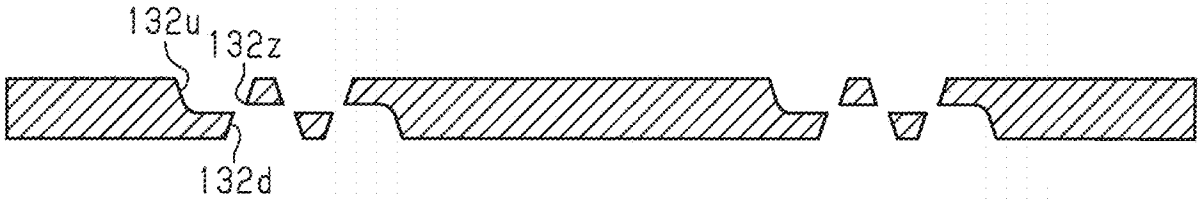

The shape of the bottomed holes in the above-described embodiment and modified examples may be changed. For example, the side wall of each bottomed hole is not limited to the tapered wall and may be perpendicular to the bottom wall of the bottomed hole. The inner wall of each bottomed hole (for example, each bottomed hole 43*u*, 43*d* illustrated in FIG. 2) may be curved. That is, each bottomed hole may have a curved concave. For example, as illustrated in FIG. 16A, each of bottomed holes 131*u* and 131*d* may be semicircular or semi-elliptical in a cross-sectional view. The bottomed holes 131*u* and 131*d* having such a configuration may be in communication with to each other and form fine pores 131*z*. FIG. 16B illustrates further bottomed holes 132*u* and 132*d*. As illustrated in FIG. 16B, the side and bottom walls of each of the bottomed holes 132*u* and 132*d* may be continuous and arcuate. The bottomed holes 132*u* and 132*d* having such a configuration may be in communication with each other and form fine pores 132*z*.

In the above-described embodiment and modified examples, the depth of an upper bottomed hole may differ from the depth of a lower bottomed hole. Also, referring to FIGS. 16A and 16B, the depth of the upper bottomed holes 131*u* and 132*u* may differ from the depth of the lower bottomed holes 131*d* and 132*d*.

The above-described embodiment and modified examples may be partially or entirely combined with each other.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to an illustration of the superiority and inferiority of the invention. Although embodiments have been described in detail, it should be understood that various changes, substitutions, and alterations could be made hereto without departing from the scope of this disclosure.

The invention claimed is:

1. A loop heat pipe comprising:

an evaporator that vaporizes working fluid;

a condenser that liquefies the working fluid vaporized by the evaporator;

a liquid pipe that connects the condenser to the evaporator and includes a flow passage that sends the working fluid liquefied by the condenser to the evaporator; and a vapor pipe that connects the evaporator to the condenser to send the working fluid vaporized by the evaporator to the condenser, wherein the liquid pipe is formed by a metal layer stack of a plurality of metal layers, the plurality of metal layers including a first metal layer through which a first through hole extends in a thickness-wise direction and a second metal layer covering the first through hole, the flow passage of the liquid pipe is formed by at least the first through hole and has four walls that define the flow passage, the four walls include an upper wall, a lower wall, and two side walls facing each other and connecting the upper wall and the lower wall, the liquid pipe further includes a plurality of porous bodies that form at least two of the upper wall, the lower wall, and the two side walls of the flow passage, and the plurality of porous bodies include:

a first porous body formed in the first metal layer to be adjacent to the first through hole; and a second porous body formed in the second metal layer to cover at least the first through hole.

2. The loop heat pipe according to claim 1, wherein the first porous body includes:

a first bottomed hole recessed in an upper surface of the first metal layer;

a second bottomed hole recessed in a lower surface of the first metal layer; and a fine pore partially connecting the first bottomed hole and the second bottomed hole.

3. The loop heat pipe according to claim 1, wherein the plurality of metal layers further include a third metal layer opposite to the second metal layer to cover the first through hole, and the plurality of porous bodies further include a third porous body formed in the third metal layer to cover at least the first through hole.

4. The loop heat pipe according to claim 3, wherein the plurality of metal layers further include:

a first outermost metal layer stacked on the second metal layer; and a second outermost metal layer stacked on the third metal layer.

5. The loop heat pipe according to claim 3, wherein the plurality of metal layers further include a fourth metal layer between the second metal layer and the third metal layer, wherein the fourth metal layer includes a second through hole extending through the fourth metal layer in the thickness-wise direction in a position overlapping with the first through hole, the flow passage includes the first through hole and the second through hole, and the plurality of porous bodies further include a fourth porous body formed in the fourth metal layer to be adjacent to the second through hole.

6. The loop heat pipe according to claim 3, wherein the plurality of metal layers further include:

a fifth metal layer stacked on the third metal layer at a position opposite to the first metal layer and including a third through hole, wherein the third through hole extends through the fifth metal layer in the thickness-wise direction in a position overlapping with the first through hole; and an outermost metal layer stacked on the fifth metal layer to cover the third through hole;

the flow passage includes:

a first flow passage including the first through hole; and a second flow passage including the third through hole, the plurality of porous bodies further include a fifth porous body formed in the fifth metal layer to be adjacent to the third through hole, and the third porous body formed in the third metal layer covers at least both of the first through hole and the third through hole.

7. The loop heat pipe according to claim 1, wherein the plurality of metal layers further include a sixth metal layer stacked on the second metal layer at a position opposite to the first metal layer, wherein the sixth metal layer includes a fourth through hole extending through the sixth metal layer in the thickness-wise direction in a position that does not overlap with the first through hole, the flow passage includes:

a first flow passage including the first through hole; and a second flow passage including the fourth through hole, and the plurality of porous bodies further include a sixth porous body formed in the sixth metal layer to be adjacent to the fourth through hole.

8. The loop heat pipe according to claim 4, wherein the first outermost metal layer includes a third bottomed hole recessed in the surface of the first outermost metal layer adjacent to the second metal layer, and the second outermost metal layer includes a fourth bottomed hole recessed in the surface of the second outermost metal layer adjacent to the third metal layer.

9. A loop heat pipe comprising:

a metal layer stack of two outermost metal layers and a plurality of intermediate metal layers located between the two outermost metal layers, wherein the metal layer stack includes an evaporator, a vapor pipe, a condenser, and a liquid pipe that are connected to form a loop, the liquid pipe includes one or more flow passages each formed as a single communication hole extending from the condenser to the evaporator along the liquid pipe, wherein each flow passage extends through at least one of the plurality of intermediate metal layers in a thickness-wise direction and has four walls that define the flow passage, the four walls including an upper wall, a lower wall, and two side walls facing each other and connecting the upper wall and the lower wall, and a plurality of porous bodies formed in at least two of the plurality of intermediate metal layers and arranged to form at least two of the upper wall, the lower wall, and the two side walls of each flow passage, the plurality of intermediate metal layers include a first metal layer through which a first through hole extends in a thickness-wise direction and a second metal layer covering the first through hole, and the plurality of porous bodies include:

a first porous body formed in the first metal layer to be adjacent to the first through hole; and a second porous body formed in the second metal layer to cover at least the first through hole.

* * * * *